US007893915B2

(12) United States Patent
Woo et al.

(10) Patent No.: US 7,893,915 B2
(45) Date of Patent: Feb. 22, 2011

(54) LIQUID CRYSTAL DISPLAY DEVICE AND DRIVING METHOD THEREOF

(75) Inventors: Jong-Hoon Woo, Incheon (KR); Ki-Bok Park, Gyeonggi (KR); Jong-Hwae Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 929 days.

(21) Appl. No.: 11/639,225

(22) Filed: Dec. 15, 2006

(65) Prior Publication Data

US 2007/0236444 A1 Oct. 11, 2007

(30) Foreign Application Priority Data

Apr. 10, 2006 (KR) ..... 10-2006-0032159

(51) Int. Cl.
*G09G 3/36* (2006.01)

(52) U.S. Cl. ..... 345/102; 345/204

(58) Field of Classification Search ..... 345/87–104, 345/204–213, 690–699
See application file for complete search history.

(56) References Cited

U.S. PATENT DOCUMENTS 6,097,367 A * 8/2000 Kuriwaki et al. ..... 345/589
2002/0060662 A1* 5/2002 Hong ..... 345/102

FOREIGN PATENT DOCUMENTS

| | | |
|---|---|---|
| JP | 2002-169515 A | 6/2002 |
| JP | 2003-241714 | 8/2003 |
| JP | 2003-248462 | 9/2003 |
| JP | 2003-280614 | 10/2003 |
| JP | 2005-233982 A | 9/2005 |

OTHER PUBLICATIONS

Office Action issued Jan. 5, 2010 in corresponding Japanese Application No. 2006-243184.

* cited by examiner

*Primary Examiner*—Amr Awad
*Assistant Examiner*—Stephen G Sherman
(74) *Attorney, Agent, or Firm*—Morgan, Lewis & Bockius LLP

(57) ABSTRACT

A liquid crystal display device includes a compensation data generating part for converting a source data signal into at least one of a conversion data signal and a compensation data signal; and a backlight unit, including a plurality of light sources, for performing a single irradiation of one of the plurality of light sources to display the conversion data signal and performing a simultaneous irradiation of at least two of the plurality of light sources to display the compensation data signal.

20 Claims, 15 Drawing Sheets

LIQUID CRYSTAL DISPLAY DEVICE AND DRIVING METHOD THEREOF

The present invention claims the benefit of Korean Patent Application No. 2006-0032159, filed in Korea on Apr. 10, 2006, which is hereby incorporated by reference in its entirety.

BACKGROUND OF THE INVENTION

1. Technical Field

The present invention relates to a liquid crystal display device, and more particularly, to a field sequential color mode liquid crystal display device and a driving method thereof.

2. Related Art

A liquid crystal display device uses a liquid crystal display panel for displaying a desired image. The liquid crystal panel includes a plurality of pixels in a matrix arrangement. A thin film transistor is disposed in each pixel. The thin film transistor switches in accordance with a data signal to control a rotation angle of liquid crystal molecules to adjust the light transmittance of the pixel in the liquid crystal panel.

The desired image is displayed by supplying light from a backlight unit to the liquid crystal panel. The backlight unit typically uses a cold cathode fluorescent lamp (CCFL) as a light source. However, a light emitting diode (LED) has been suggested as a replacement for CCFL because an LED consumes less power. LEDs are also lightweight and bright, and very suitable for small, thin and lightweight liquid crystal display (LCD) devices.

High quality image display can be achieved using a field sequential color (FSC) mode LCD device. In a FSC driving mode LCD device, a multicolor image is displayed by sequentially operating LEDs, which displays three primary colors (red, green and blue) using an afterimage effect, without using color filters. Specifically, each frame period is divided into three periods corresponding to red, green and blue, respectively. A corresponding LED emits light during one of the three periods.

FIG. 1 shows a frame in a FSC driving mode according to the related art. Referring to FIG. 1, in the FSC driving mode, each frame period is divided into three sub-frames, corresponding to red, green and blue, respectively. For example, if a frame period is about 16.7 ms, which corresponds to a frame rate of 60 Hz, then each sub-frame is about 5.56 ms.

Each sub-frame is in turn divided into a data-writing interval DW, a liquid crystal response interval LR, and a backlight irradiating interval BL. The data-writing interval DW is about 1.69 ms depending on a thin film transistor scanning. The liquid crystal response interval LR is about 1.5 ms depending on the data writing. The backlight irradiating interval BL, which is a time for turning on the backlight for each color, is the time remaining in the corresponding subframe period after the data writing interval DW and the liquid crystal response interval LR.

Red, green and blue data signals are sequentially inputted to a liquid crystal panel in the corresponding sub-frames. Then, the corresponding red, green and blue light sources are sequentially turned on. The red, green and blue light sources are sequentially arranged below the LCD panel. Each of the light sources can be an LED or a fluorescent lamp.

As the red, green and blue light sources are sequentially turned on, color light emitted from the corresponding light sources are perceived at slightly varying locations by a user due to the sequential arrangement of the light sources. Accordingly, the red, green and blue light fail to mix, but a color break-up occurs causing each color light to be separately perceived for a short time rather than a white light. The color break-up gets worse with a user's eye motion or when displaying a moving image. Also, the FSC driving method causes color mixture distortion due to liquid crystal response delay.

FIG. 2 is a graph showing variations of the light transmittance of liquid crystal in relation to liquid crystal response time in the related art FSC driving mode LCD device. When red and green are mixed to display yellow, for example, since a green sub-frame B follows a red sub-frame A, the liquid crystal response is faster in the green sub-frame B than in the red sub-frame A. Accordingly, green light has a transmittance higher than red light. Thus, yellow shifted toward green is displayed. The color mixture distortion is more pronounced when displaying yellow.

Accordingly, there is a need for an LCD device with better mixing of the red, green and blue light sources to achieve better color display. Moreover, the LCD device should be able to prevent color break-up when displaying white. Further, the LCD should be able to display color image without a deterioration of the color image quality due to a user's eye motion or when displaying a moving image.

SUMMARY OF THE INVENTION

Accordingly, the present invention is directed to a field sequential color mode liquid crystal display device and a driving method thereof that substantially obviate one or more problems due to limitations and disadvantages of the related art.

An object of the present invention is to provide a field sequential color mode liquid crystal display device and a driving method thereof that provide a mixing of the red, green and blue light sources to achieve improved color quality.

Another object of the present invention is to provide a field sequential color mode liquid crystal display device and a driving method thereof that prevent break-up of the red, green and blue colors when displaying a color image.

Still another object of the invention is to provide a field sequential color mode liquid crystal display device and a driving method thereof that prevents deterioration of the color image quality due to a user's eye motion or when displaying a moving image.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device includes a compensation data generating part for converting a source data signal into at least one of a conversion data signal and a compensation data signal; and a backlight unit, including a plurality of light sources, for performing a single irradiation of one of the plurality of light sources to display the conversion data signal and performing a simultaneous irradiation of at least two of the plurality of light sources to display the compensation data signal.

In another aspect, a method of driving a liquid crystal display device includes converting a source data signal into at least one of a conversion data signal and a compensation data signal; and performing a single irradiation of one of a plurality of light sources to display the conversion data signal and performing a simultaneous irradiation of at least two of the plurality of light sources to display the compensation data signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF EXEMPLARY EMBODIMENTS

Reference will now be made in detail to embodiments, which are illustrated in the accompanying drawings. Wherever possible, the same reference numbers will be used throughout the drawings to refer to the same or like parts.

Figure 1:
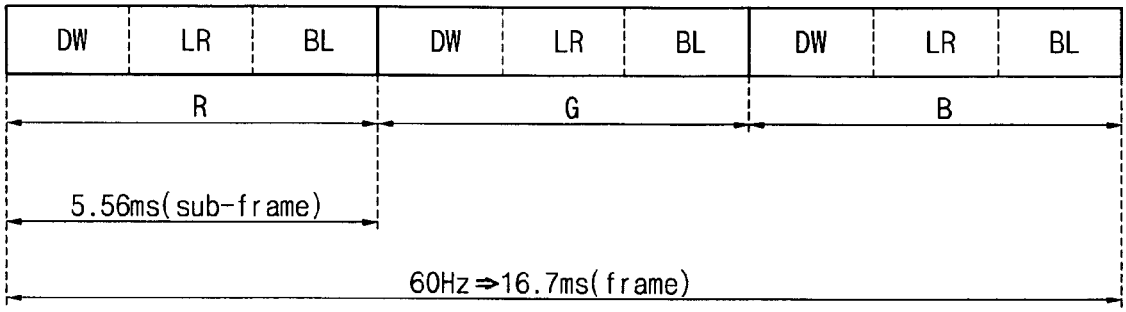
FIG. 1 RELATED ART
FIG. 1 shows a frame in a FSC driving mode according to the related art.
Figure 2:
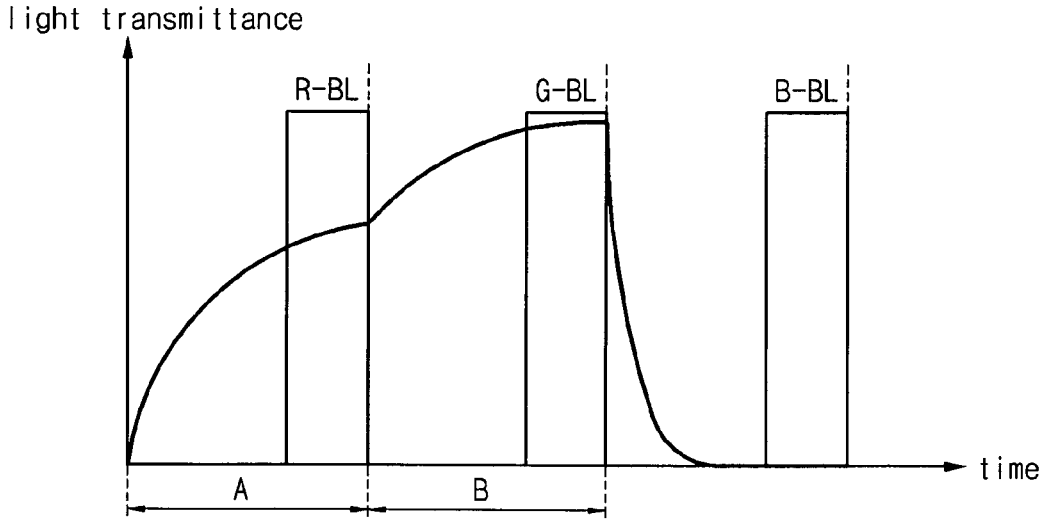
FIG. 2 RELATED ART
FIG. 2 is a graph showing variations of the light transmittance of liquid crystal in relation to liquid crystal response time in the related art FSC driving mode LCD device.
Figure 3:
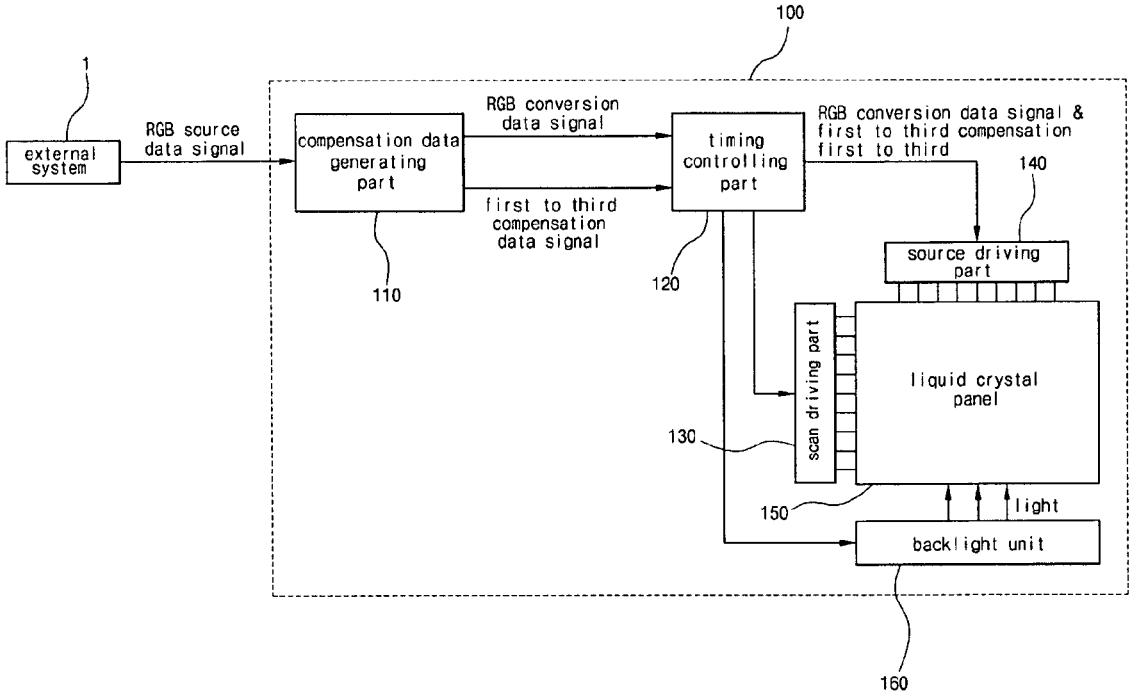
FIG. 3 is a block diagram of an exemplary FSC driving mode LCD device according to a first embodiment of the present invention.

FIG. 3 is a block diagram of an exemplary FSC driving mode LCD device according to a first embodiment of the present invention. The FSC driving mode LCD device of FIG. 3 reduces color mixture distortion. Referring to FIG. 3, an external system 1, such as a television system or computer system, provides RGB source data signals to a liquid crystal display (LCD) device 100. The RGB source data signals may have a digital format.

The LCD device 100 includes a compensation data generating part 110. The compensation data generating part 110 is inputted with the RGB source data signals from the external system 1. The compensation data generating part 110 performs arithmetic and/or logical operations, such as addition and subtraction, on the RGB source data signals to generate RGB conversion data signals and first to third compensation data signals. The RGB conversion data signals may have a digital format. The first to third compensation data signals can also have a digital format and allows the display of yellow (Y), cyan (C) and magenta (M).

The LCD device 100 includes a timing controlling part 120, a scan driving part 130 and a source driving part 140. The timing controlling part 120 is inputted with the RGB conversion data signals and the first to third compensation data signals from the compensation data generating part 110. The timing controlling part 120 outputs the RGB conversion data signals and the first to third compensation data signals. Also, the timing controlling part 120 outputs control signals to control the scan driving part 130 and the source driving part 140 in response to vertical and horizontal synchronizing signals (Vsync and Hsync, not shown) and a clock signal (not shown). The scan driving part 130 generates scan signals according to the control signals outputted from the timing controlling part 120 and outputs the scan signals according to the vertical synchronizing signal (Vsync).

The source driving part 140 is inputted with the RGB conversion data signals and the first to third compensation data signals from the timing controlling part 120. The source driving part 140 converts the RGB conversion data signals into signals having an analog format and outputs the analog data signals to a liquid crystal panel 150. The source driving part 140 outputs the RGB conversion data signals and the first to third compensation data signals according to the horizontal synchronizing signal (Hsync).

The liquid crystal panel 150 includes a plurality of pixels arranged in a matrix form. Thin film transistors are electrically connected to each of the pixels to selectively apply the RGB conversion data signals and the first to third compensation data signals to the pixels. The RGB conversion data signals and the first to third compensation data signals are applied to the pixels by switching the corresponding thin film transistors using the scan signals outputted from the scan driving part 130.

The LCD device 100 further includes a backlight unit 160. The backlight unit 160 supplies light to the liquid crystal panel 150. The operation of the backlight unit is controlled by the timing controlling part 120.

Figure 4:
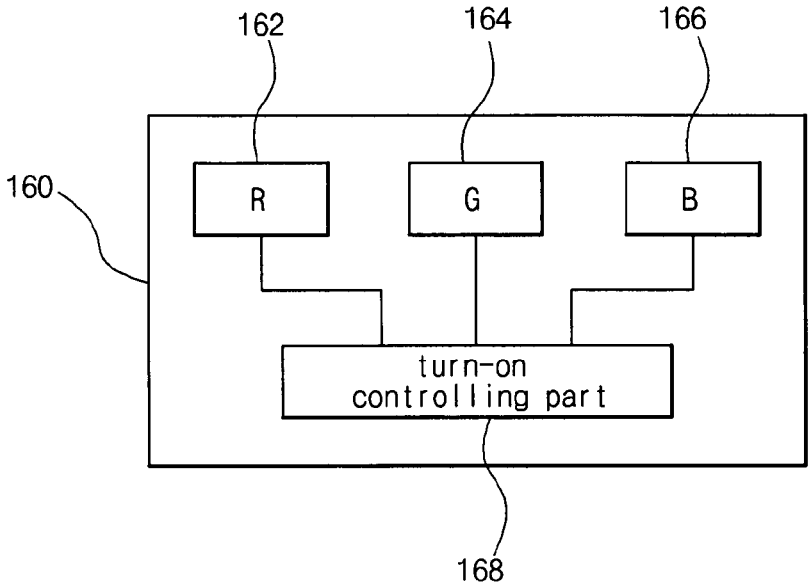
FIG. 4 is a block diagram illustrating the backlight unit of FIG. 3.

FIG. 4 is a block diagram illustrating the backlight unit of FIG. 3. Referring to FIG. 4, the backlight unit 160 includes red, green and blue light sources 162, 164 and 166 for supplying the FSC driving mode LCD device (shown in FIG. 3). Each light source 162, 164 and 166 may include an LED or fluorescent lamp. The backlight unit 160 further includes a turn-on controlling part 168. The turn-on controlling part 168 controls the light sources 162, 164 and 166 to perform single irradiation or simultaneous irradiation of the light sources 162, 164 and 166. An inverter may be used as the turn-on controlling part 168. A mixed color is displayed by simultaneously turning on at least two of the light sources 162, 164 and 166. The FSC driving mode LCD device reduces color mixture distortion caused by liquid crystal response delay by generating data signals to display mixed colors on the liquid crystal panel.

Data signals for displaying mixed colors are generated based on the RGB source data signals. A sub-frame for each mixed color is added in the frame period. Since the mixed colors are separately displayed during different sub-frames, the RGB source data signals are subtracted from the data signal values corresponding to the mixed colors. The data signals generated by this process are the RGB conversion data signals. In the first embodiment, yellow (Y), cyan (C) and magenta (M) are used as exemplary mixed colors. Selection of the mixed colors may be changed according to need of improving the color mixture property for a specific color.

Figure 5:
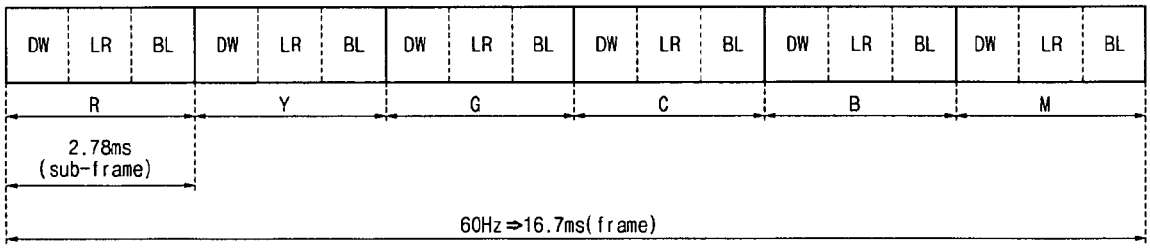
FIG. 5 shows an exemplary partitioning of a frame driven in a FSC driving mode according to the first embodiment of the present invention.

FIG. 5 shows an exemplary partitioning of a frame driven in a FSC driving mode according to the first embodiment of the present invention. Referring to FIG. 5, each frame period is divided into six sub-frames, corresponding to red (R), yellow (Y), green (G), cyan (C), blue (B) and magenta (M), respectively. Each sub-frame is in turn divided into a data-writing interval DW, a liquid crystal response interval LR, and a backlight irradiating interval BL. The backlight irradiating interval BL, which is a time for turning on the backlight for each color, is the time remaining in the corresponding subframe period after the data writing interval DW and the liquid crystal response interval LR.

As shown in FIG. 5, when the LCD device has a frame period of about 16.7 ms, which corresponds to a frame rate of about 60 Hz, a sub-frame for displaying each of the RGB conversion data signals and each of the first to third compensation data signals has a period of about 2.78 ms, which corresponds to 16.7/6. Then, the backlight irradiating interval BL is shorter than 2.78 ms. According to an embodiment as shown in FIG. 5, the R, Y, G, C, B and M sub-frames are sequentially arranged. However, the order of the colors may be changed in other embodiments.

Figure 6:
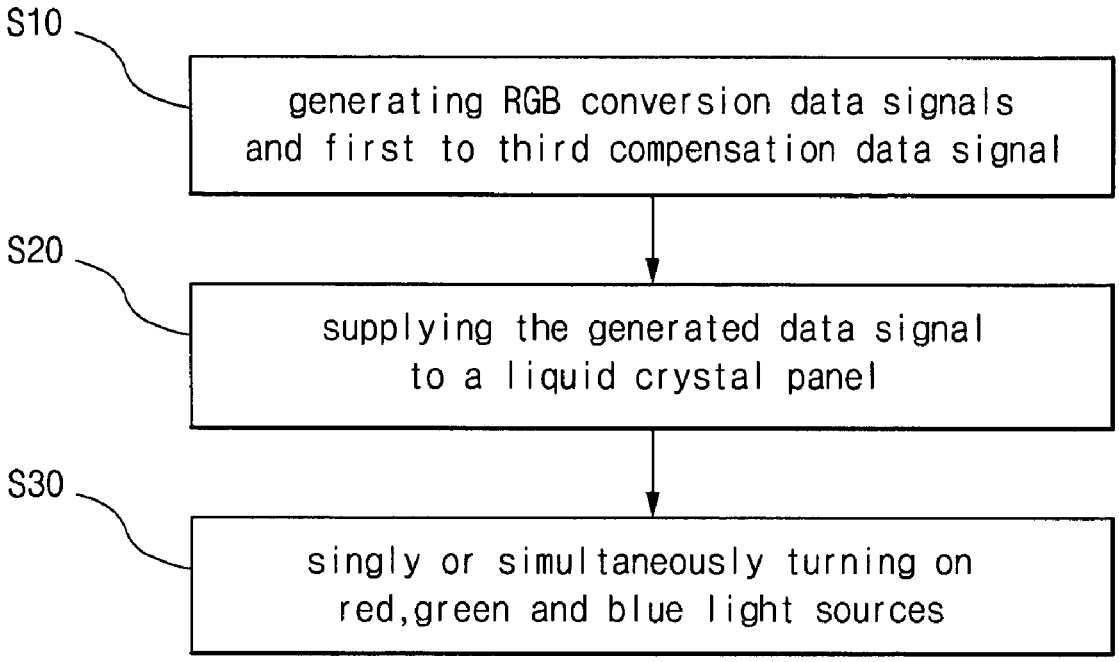
FIG. 6 is an exemplary flow chart illustrating an operation of the FSC driving mode LCD device according to the first embodiment of the present invention.

FIG. 6 is an exemplary flow chart illustrating an operation of the FSC driving mode LCD device according to the first embodiment of the present invention. Referring to FIG. 6, the RGB conversion data signals and the first to third compensation data signals from RGB source data signals are generated during a first step S10 in the FSC driving mode LCD device. The RGB conversion data signals and the first to third compensation data signals are supplied to the liquid crystal panel 150 (shown in FIG. 3) during a second step S20. Then, the red, green and blue light sources from the backlight unit 160 are singly or simultaneously turned on during a third step S30 when each data signal is inputted to the liquid crystal panel 150 (shown in FIG. 3).

Figure 7:
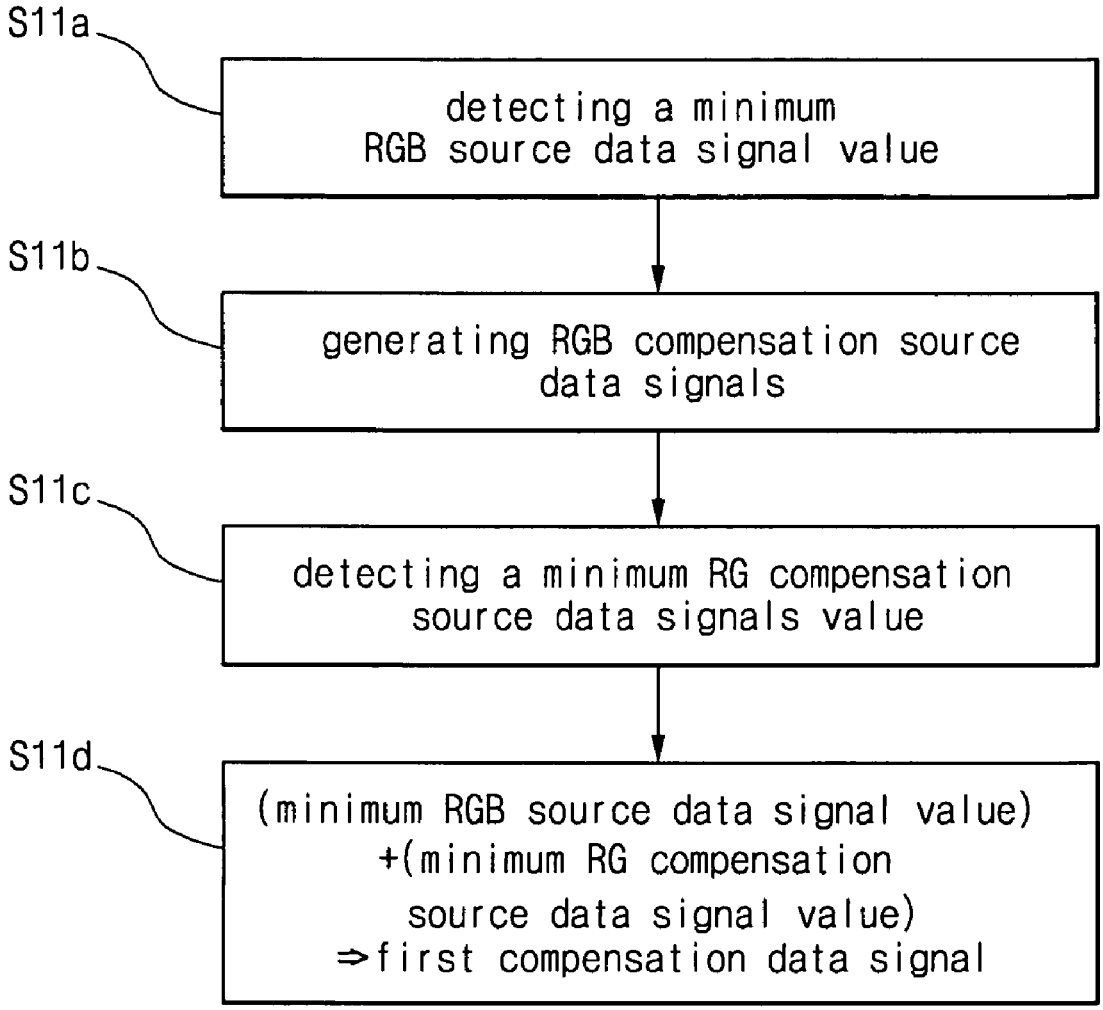
FIG. 7 is an exemplary flow chart illustrating a process for generating a first compensation data signal in the FSC driving mode LCD device according to the first embodiment of the present invention.

FIG. 7 is an exemplary flow chart illustrating a process for generating a first compensation data signal in the FSC driving mode LCD device according to the first embodiment of the present invention. The first compensation data signal may correspond to yellow, which is a mixture of red and green. During a first step S11*a*, a minimum RGB source data signal value is detected between the RGB source data signal values. During a second step S11*b*, the minimum RGB source data signal is subtracted from the RGB source data signals to generate R, G and B compensation source data signals. During a third step S11*c*, a minimum RG compensation source data signal value is detected between the R and G compensation source data signal values. During a fourth step S11*d*, the first compensation data signal is generated by adding the minimum RGB source data signal value to the minimum RG compensation source data signal value.

Figure 8:
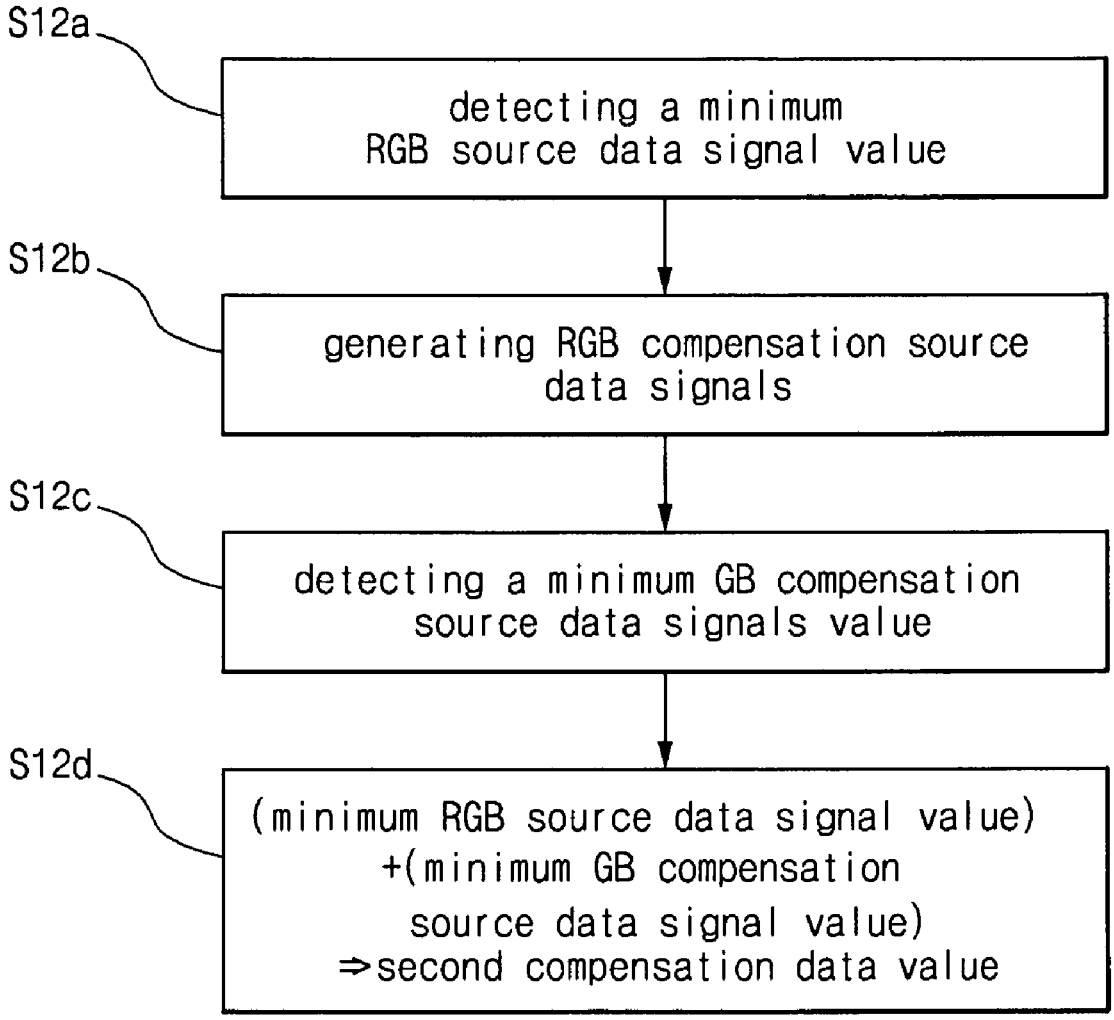
FIG. 8 is an exemplary flow chart illustrating a process for generating a second compensation data signal in the FSC driving mode LCD device according to the first embodiment of the present invention.

FIG. 8 is an exemplary flow chart illustrating a process for generating a second compensation data signal in the FSC driving mode LCD device according to the first embodiment of the present invention. The second compensation data signal may correspond to cyan, which is a mixture of green and blue. During a first step S12*a*, a minimum RGB source data signal value is detected between the RGB source data signal values. During a second step S12*b*, the minimum RGB source data signal is subtracted from the RGB source data signals to generate R, G and B compensation source data signals. During a third step S12*c*, a minimum GB compensation source data signal value is detected between the G and B compensation source data signal values. During a fourth step S12*d*, the second compensation data signal is generated by adding the minimum RGB source data signal value to the minimum GB compensation source data signal value.

Figure 9:
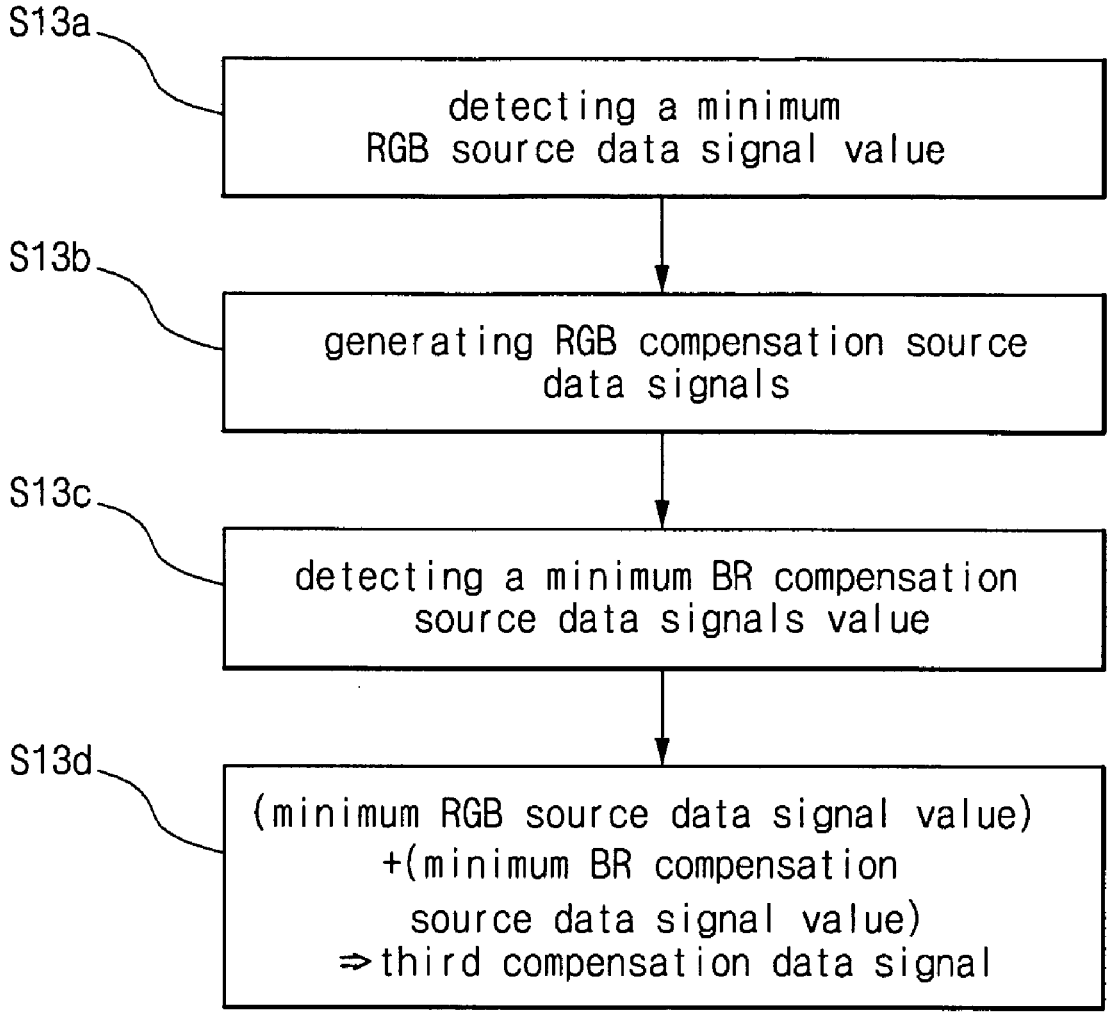
FIG. 9 is an exemplary flow chart illustrating a process for generating a third compensation data signal in the FSC driving mode LCD device according to the first embodiment of the present invention.

FIG. 9 is an exemplary flow chart illustrating a process for generating a third compensation data signal in the FSC driving mode LCD device according to the first embodiment of the present invention. The third compensation data signal may correspond to magenta, which is a mixture of blue and red. During a first step S13*a*, a minimum RGB source data signal value is detected between the RGB source data signal values. During a second step S13*b*, the minimum RGB source data signal is subtracted from the RGB source data signals to generate R, G and B compensation source data signals. During a third step S13*c*, a minimum BR compensation source data signal value is detected between the R and B compensation source data signal values. During a fourth step S13*d*, the third compensation data signal is generated by adding the minimum RGB source data signal value to the minimum BR compensation source data signal value.

Figure 10:
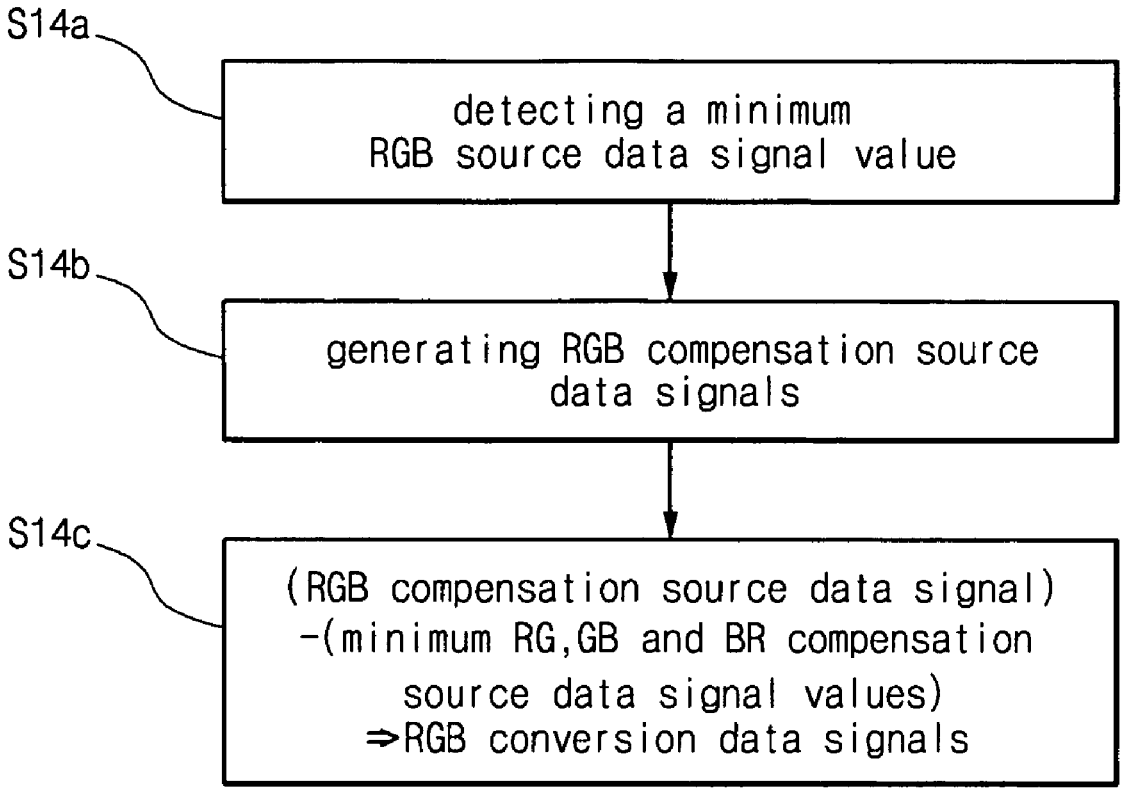
FIG. 10 is an exemplary flow chart illustrating a process for generating RGB conversion data signals in the FSC driving mode LCD device according to the first embodiment of the present invention.

FIG. 10 is an exemplary flow chart illustrating a process for generating RGB conversion data signals in the FSC driving mode LCD device according to the first embodiment of the present invention. The mixed colors corresponding to the first to third compensation data signals may overlap with the red, green and blue of the RGB source data signals. Thus, the RGB conversion data signals are generated by subtracting the overlapped color amounts from the RGB source data signals. For example, during a first step S14*a*, a minimum RGB source data signal value is detected between the RGB source data signal values. During a second step S14*b*, the minimum RGB source data signal value is subtracted from the RGB source data to generate R, G and B compensation source data signals. During a step S14*c*, the RGB conversion data signals are generated by subtracting the minimum RG, GB and BR compensation source data signal values from the R, G and B compensation source data signals. For example:

(1) R conversion data signal value={R compensation source data signal value−(minimum RG compensation source data signal value+minimum GB compensation source data signal value+minimum BR compensation source data signal value)}

(2) G conversion data signal value={G compensation source data signal value−(minimum RG compensation source data signal value+minimum GB compensation source data signal value+minimum BR compensation source data signal value)}

(3) B conversion data signal value={B compensation source data signal value−(minimum RG compensation source data signal value+minimum GB compensation source data signal value+minimum BR compensation source data signal value)}.

In an embodiment, the above data signals have a digital format. Then, the RGB conversion data signals and the first to third compensation data signals are generated by addition and subtraction operations of the RGB source data signals. Also, when a subtracted result is a negative value, for example, a data signal value of 0 is subtracted by a data signal value of 70, the subtracted result is considered as 0.

The RGB conversion data signals and the first to third compensation data signals generated by the above processes are supplied to the liquid crystal display panel 150. In other words, the RGB conversion data signals and the first to third compensation data signals are transferred to the timing controlling part 120. The timing controlling part 120 outputs the RGB conversion data signals, the first to third compensation data signals and control signals to the source driving part 140, and outputs control signals to the scan driving part 130.

The source driving part 140 may convert the data signals received from the timing controlling part 120 to analog voltages in a DAC (data-to-analog converter) using gamma reference voltages. The converted data signals are outputted to the liquid crystal panel 150 in synchronization with the scan signals from the timing controlling part 120. The light sources in the backlight unit 160 are turned on when the RGB conversion data signals and the first to third compensation data signals are inputted to the liquid crystal panel 150.

Referring back to FIG. 4, the turn-on controlling part 168 controls one light source corresponding to each data signals for red, green and blue colors in sub-frames when the data signals for red, green and blue colors are inputted. The turn-on controlling part 168 turn on two or more light sources 162, 164 and 166 concurrently to irradiate a mixed color light in sub-frames when the first to third compensation data signals are inputted. Thus, when the sub-frames for R, Y, G, C, B and M are sequentially arranged, the turn-on controlling part 168 sequentially turn on the light sources 162, 164 and 166 as follows: (1) the red light source singly, (2) the red and green light sources simultaneously, (3) the green light source singly, (4) the green and blue light sources simultaneously, (5) the blue light source singly, and (6) the blue and red light sources simultaneously. An operation of the FSC driving mode LCD device of the first embodiment is explained with some comparative examples.

Figure 11:
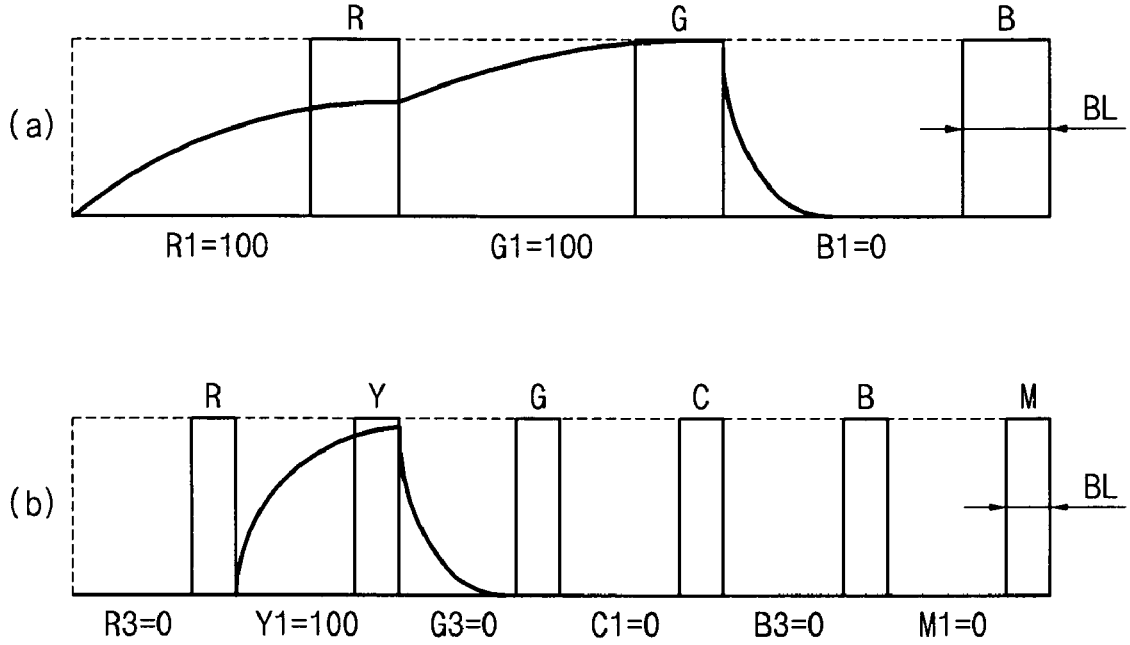
FIG. 11 shows a first graphical comparison between variations of light transmittances across the sub-frames in the related art FSC driving mode LCD device and in the first embodiment of the present invention when displaying yellow.

FIG. 11 shows a first graphical comparison between variations of light transmittances across the sub-frames in the related art FSC driving mode LCD device and in the first embodiment of the present invention when displaying yellow. Referring to FIG. 11, graph (a) illustrates variations of light transmittances through sub-frames of RGB source data signals in the related art FSC driving mode LCD device, and graph (b) illustrates the variations of light transmittance through sub-frames of RGB conversion data signals and first to third compensation data signals in the FSC driving mode LCD device according to the first embodiment of the present invention, when displaying yellow. Data signals values are listed below each graph and within each corresponding sub-frame. The maximum data signal value, which corresponds to the highest brightness, is assumed to be 100.

As shown in FIG. 11, graph (a), the exemplary R and G source data signal values are 100. However, due to liquid crystal response delay, green has a light transmittance higher than red. Accordingly, color mixture distortion occurs causing a shift of yellow to green.

According to the first embodiment of the present invention, the color mixture distortion is prevented by the generation of RGB conversion data signals and first to third compensation data signals to display yellow from RGB source data signals. Thus, the RGB source data signals have signal values, R1=100, G1=100 and B1=0, respectively. The minimum RGB source data signal value is 0 for blue. Accordingly, R, G and B compensation source data signals have signal values, R2=(100−0)=100, G2=(100−0)=100, and B2=(0−0)=0.

A minimum RG compensation source data signal value of 100 is obtained by finding the minimum between R2=100 and G2=100. Accordingly, the first compensation data signal has a value Y1=100 obtained by adding the minimum RGB source data signal value of 0 to the minimum RG compensation source data signal value of 100.

A minimum GB compensation source data signal value of 0 by finding the minimum between G2=100 and B2=0. Accordingly, the second compensation data signal has a value C1=0 obtained by adding the minimum RGB source data signal value of 0 to the minimum GB compensation source data signal value of 0.

A minimum BR compensation source data signal value of 0 is obtained by finding the minimum between B2=0 and R2=100. Accordingly, the third compensation data signal has a value of M1=0 obtained by adding the minimum RGB source data signal value of 0 to the minimum BR compensation source data signal value of 0.

For RGB conversion data signals, the minimum RGB source data signal is 0, and the R, G and B compensation source data signals have the signal values, R2=100, G2=100 and B2=0. The sum of the minimum RG compensation source data signal value, the minimum GB compensation source data signal value and the minimum BR compensation source data signal value is 100+0+0, which is 100. Thus, RGB conversion data signals of R3=0, G3=0 and B3=0 are generated by subtracting the sum of the minimum RG, GB and BR compensation source data signals from the R, G and B compensation source data signals.

Accordingly, as illustrated in FIG. 11, graph (b), the data signals outputted from the compensation data generating part 110 have signal values R3=0, Y1=100, G3=0, C1=0, B3=0 and M1=0, and only yellow is displayed. Accordingly, color mixture distortion does not occur. In the sub-frame when yellow is displayed, red and green light sources irradiate simultaneously. A reference BL represents the backlight-irradiation interval.

Figure 12:
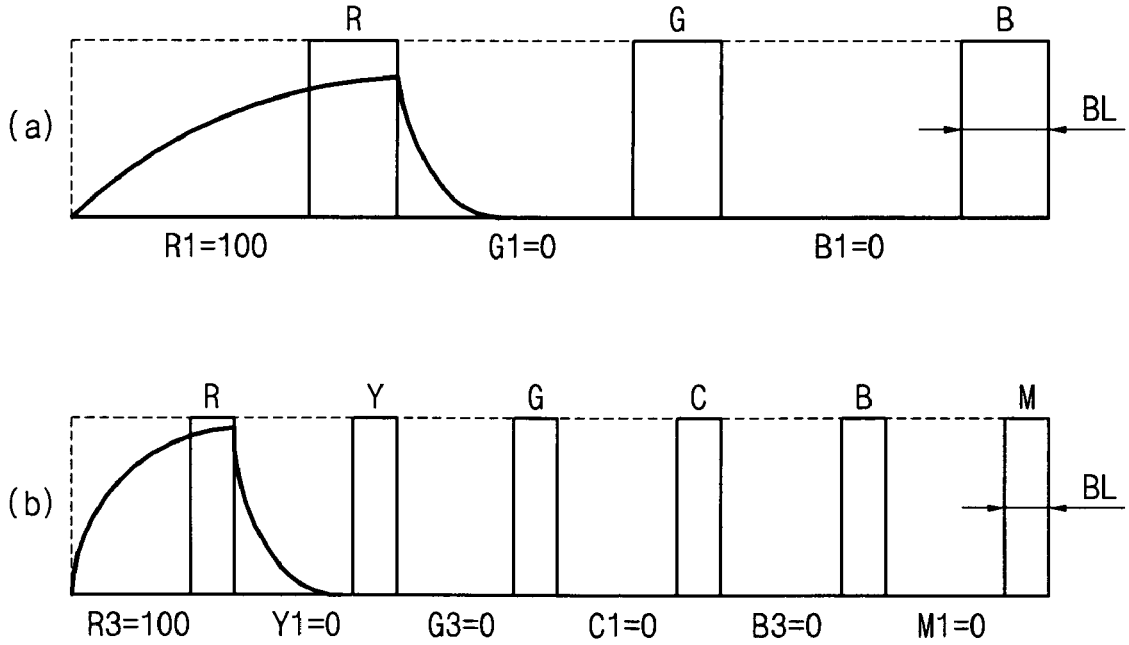
FIG. 12 shows a second graphical comparison between variations of light transmittances across the sub-frames in the related art FSC driving mode LCD device and in the first embodiment of the present invention when displaying red.

FIG. 12 shows a second graphical comparison between variations of light transmittances across the sub-frames in the related art FSC driving mode LCD device and in the first embodiment of the present invention when displaying red. Referring to FIG. 12, graph (a) illustrates light transmittances through sub-frames of RGB source data signals in the related art FSC driving mode LCD device, and graph (b) illustrates light transmittance through sub-frames of RGB conversion data signals and first to third compensation data signals in the FSC driving mode LCD device according to the first embodiment of the present invention, when displaying red. Data signals values are listed below each graph and within each corresponding sub-frame. The maximum data signal value, which corresponds to the highest brightness, is assumed to be 100. As shown in FIG. 12, graph (a), a R source data signal value of 100 is inputted to display red.

RGB conversion data signals and first to third compensation data signals are generated as follows, in accordance with the first embodiment of the present invention. The RGB source data signals have signal values, R1=100, G1=0 and B1=0, respectively. The corresponding minimum RGB source data signal value is 0. Accordingly, R, G and B compensation source data signals have signal values, R2=(100−0)=100, G2=(0−0)=0, and B2=(0−0)=0.

The minimum RG compensation source data signal, which is the minimum between R2=100 and G2=0, has a value of 0. Accordingly, the first compensation data signal, which is obtained by adding the minimum RGB source data signal value of 0 to the minimum RG compensation source data signal value of 0, has a signal value of Y1=0.

Similarly, the minimum GB compensation source data signal value, which is the minimum between G2=0 and B2=0, is also 0. Accordingly, the second compensation data signal, which is obtained by adding the minimum RGB source data signal value of 0 to the minimum GB compensation source data signal value of 0, has a signal value of C1=0.

Furthermore, the minimum BR compensation source data signal value, which is the minimum between B2=0 and R2=100, is also 0. Accordingly, the third compensation data signal, which is obtained by adding the minimum RGB source data signal value of 0 to the minimum BR compensation source data signal value of 0, also has a data signal value of M1=0.

The minimum RGB source data signal is 0, and the R, G and B compensation source data signals have the signal values, R2=100, G2=0 and B2=0. By subtracting a value of 0, (which is the minimum RG compensation source data signal value+the minimum GB compensation source data signal value+the minimum BR compensation source data signal value), from the R, G and B compensation source data signals, RGB conversion data signals having signal values, R3=100, G3=0 and B3=0, respectively, are generated.

Accordingly, the data signals, which are outputted from the compensation data generating part, have signal values, R3=100, Y1=0, G3=0, C1=0, B3=0 and M1=0, as illustrated in the graph (b). Thus, red is displayed. In the sub-frame when red is displayed, a red light source irradiates. A reference BL represents a backlight-irradiation interval.

Figure 13:
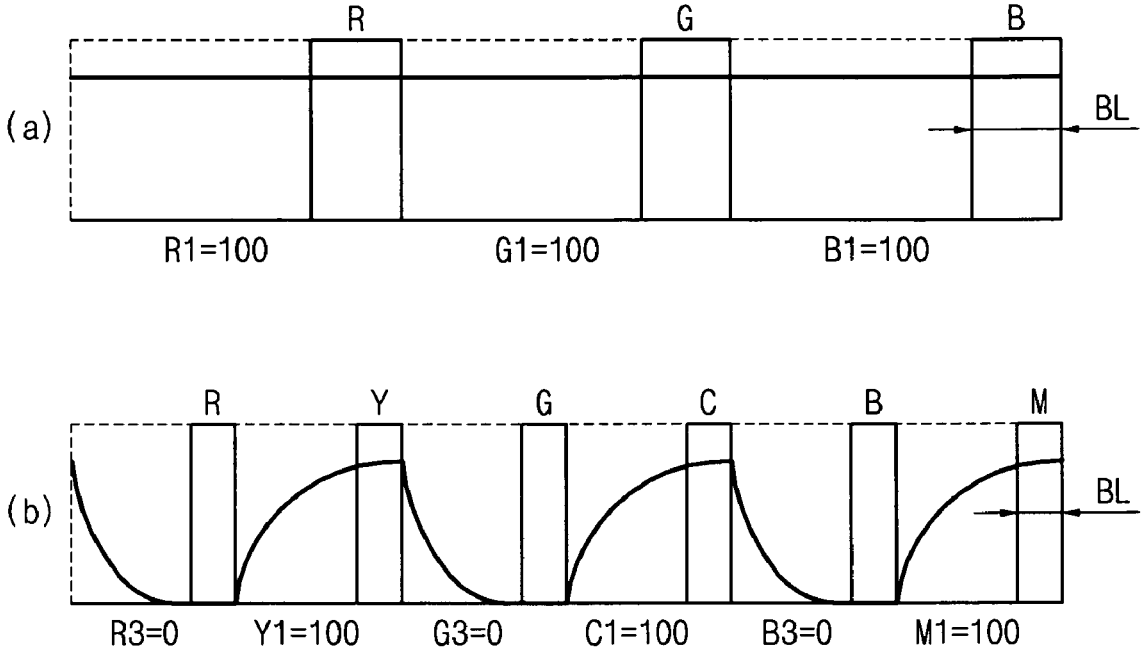
FIG. 13 shows a third graphical comparison between variations of light transmittances across the sub-frames in the related art FSC driving mode LCD device and in the first embodiment of the present invention when displaying white.

FIG. 13 shows a third graphical comparison between variations of light transmittances across the sub-frames in the related art FSC driving mode LCD device and in the first embodiment of the present invention when displaying white. FIG. 13, graph (a), illustrates light transmittances through sub-frames of RGB source data signals, when the related art FSC driving mode LCD device is displaying white. FIG. 13, graph (b) illustrates light transmittance through sub-frames of RGB conversion data signals and first to third compensation data signals, when the FSC driving mode LCD device according to the first embodiment of the present invention is displaying white. Data signals values are listed below each graph and within each corresponding sub-frame. The maximum data signal value, which corresponds to the highest brightness, is assumed to be 100. As shown in FIG. 13, graph (a), RGB source data signal values are 100 to display white, according to the related art FSC driving mode LCD device.

According to the first embodiment, RGB conversion data signals and first to third compensation data signals are generated as follows to display white. The RGB source data signals have signal values, R1=100, G1=100 and B1=100, respectively. The minimum RGB source data signal value is 100. Accordingly, the R, G and B compensation source data signals have signal values, R2=(100−100)=0, G2=(100−100)=0, and B2=(100−100)=0, respectively.

The minimum RG compensation source data signal value is 0, which is the minimum between R2=0 and G2=0. Accordingly, the first compensation data signal has a value of Y1=100, which is obtained by adding the minimum RGB source data signal value of 100 to the minimum RG compensation source data signal value of 0.

The minimum GB compensation source data signal value is 0, which is the minimum between G2=0 and B2=0. Accordingly, the second compensation data signal has a value of C1=100, which is obtained by adding the minimum RGB source data signal value of 100 to the minimum GB compensation source data signal value of 0.

The minimum BR compensation source data signal value is 0, which is the minimum between B2=0 and R2=0. Accordingly, the third compensation data has a value of M1=100, which is obtained by adding the minimum RGB source data signal value of 100 to the minimum BR compensation source data signal value of 0.

The minimum RGB source data signal is 0, and the R, G and B compensation source data signals have the signal values, R2=0, G2=0 and B2=0, respectively. By subtracting a value of 0, (which is the minimum RG compensation source data signal value+the minimum GB compensation source data signal value+the minimum BR compensation source data signal value), from the R, G and B compensation source data signals, RGB conversion data signals having signal values, R3=0, G3=0 and B3=0, respectively, are generated.

Accordingly, the data signals, which are outputted from the compensation data generating part, have signal values, R3=0, Y1=100, G3=0, C1=100, B3=0 and M1=100, respectively. Thus, as illustrated in FIG. 13, graph (b), white is displayed by mixing yellow, cyan and magenta. In the sub-frames when yellow, cyan and magenta are displayed, respectively, red and green light sources, green and blue light sources, and blue and red light sources, respectively, irradiates simultaneously. A reference BL represents a backlight-irradiation interval.

Figure 14:
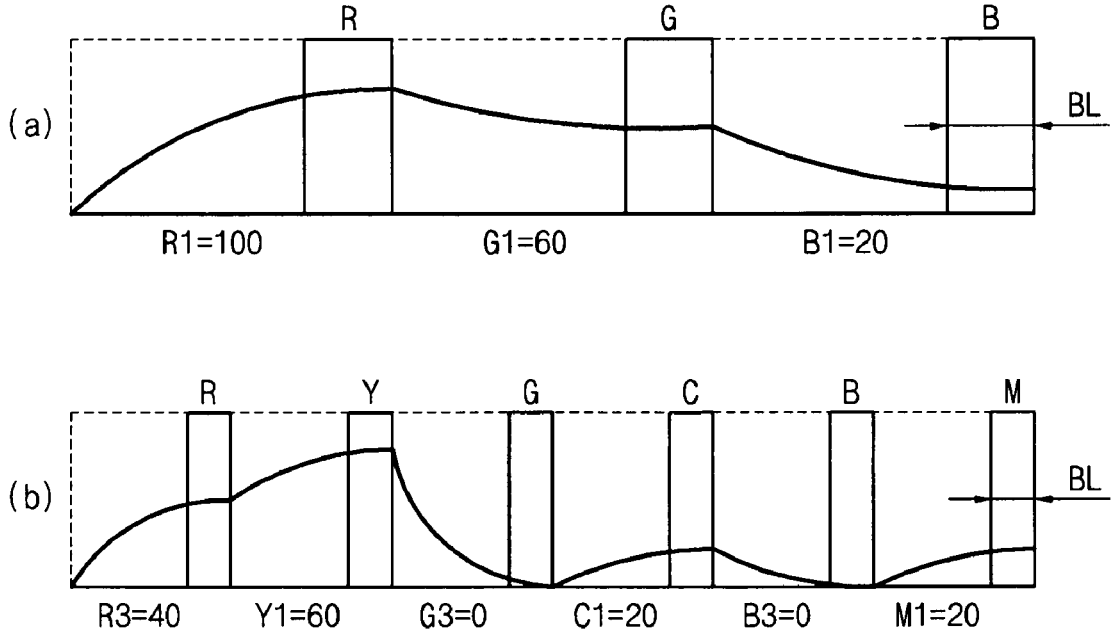
FIG. 14 shows a fourth graphical comparison between variations of light transmittances across the sub-frames in the related art FSC driving mode LCD device and in the first embodiment of the present invention when displaying an exemplary arbitrary color.

FIG. 14 shows a fourth graphical comparison between variations of light transmittances across the sub-frames in the related art FSC driving mode LCD device and in the first embodiment of the present invention when displaying an exemplary arbitrary color. FIG. 14, graph (a), illustrates light transmittances through sub-frames of RGB source data signals, when the related art FSC driving mode LCD device is displaying the arbitrary color. FIG. 14, graph (b), illustrates light transmittance through sub-frames of RGB conversion data signals and first to third compensation data signals, when the FSC driving mode LCD device according to the first embodiment of the present invention is displaying the arbitrary color. Data signals values are listed below each graph and within each corresponding sub-frame. The maximum data signal value, which corresponds to the highest brightness, is assumed to be 100. As illustrated in FIG. 14, graph (a), the RGB source data signal values are R1=100, G1=60 and B1=20 corresponding to an exemplary arbitrary color.

In accordance with the first embodiment of the present invention, RGB conversion data signals and first to third compensation data signals are generated as follows to display the exemplary arbitrary color in the FSC driving mode LCD device. The RGB source data signals have signal values, R1=100, G1=60 and B1=20. Thus, the minimum RGB source data signal value is 20. Accordingly, the corresponding R, G and B compensation source data signals have signal values, R2=(100−20)=80, G2=(60−20)=40, and B2=(20−20)=0, respectively.

The minimum RG compensation source data signal value is 40, which is the minimum between R2=60 and G2=40. Accordingly, the first compensation data signal has a value of Y1=60, which is obtained by adding the minimum RGB source data signal value of 20 to the minimum RG compensation source data signal value of 40.

The minimum GB compensation source data signal value is 0, which is the minimum between G2=40 and B2=0. Accordingly, the second compensation data has a value of C1=20, which is obtained by adding the minimum RGB source data signal value of 20 to the minimum GB compensation source data signal value of 0.

The minimum BR compensation source data signal value is 0, which is the minimum between B2=0 and R2=80. Accordingly, the third compensation data signal has a signal value M1=20, which is obtained by adding the minimum RGB source data signal value of 20 to the minimum BR compensation source data signal value of 0.

The minimum RGB source data signal is 20, and the R, G and B compensation source data signals have the signal values, R2=80, G2=40 and B2=0, respectively. By subtracting a value 40, (which is the summation of the minimum RG compensation source data signal value, the minimum GB compensation source data signal value, and the minimum BR compensation source data signal value), from the R, G and B compensation source data signals, respectively, RGB conversion data signals having signal values, R3=40, G3=0 and B3=0, respectively, are generated.

Accordingly, the data signals outputted from the compensation data generating part have signal values, R3=40, Y1=60, G3=0, C1=20, B3=0 and M1=20, as illustrated in FIG. 14, graph (b). In the sub-frames, red, green and blue light sources irradiate singly or simultaneously to emit color lights corresponding to the sub-frames. A reference BL represents a backlight-irradiation interval.

As explained above, the FSC driving mode LCD device of the first embodiment display an image using more colors than the related art. Accordingly, color break-up and color mixture distortion are improved. Also, the reproduction rate for solid color is not reduced. Further, when displaying mixed colors including white color, at least two light sources irradiate simultaneously to emit yellow, cyan and magenta. Thus, brightness increases.

Figure 15:
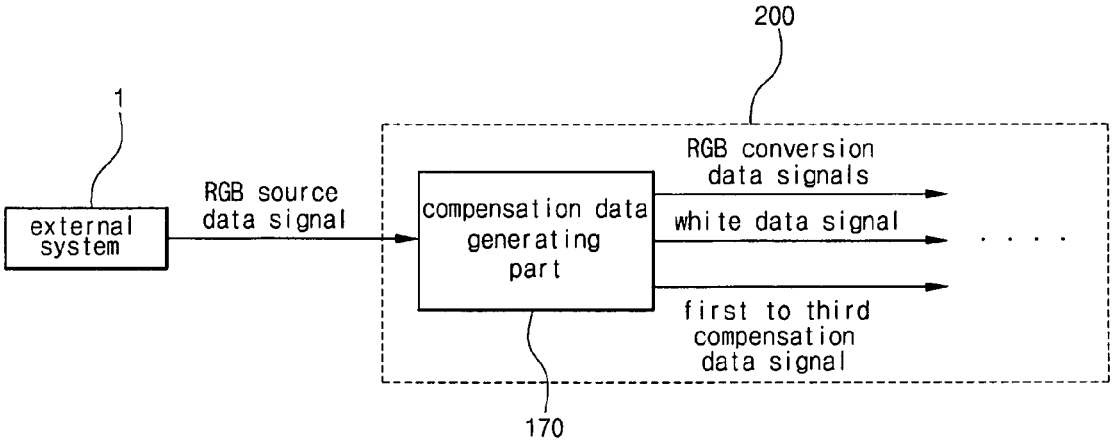
FIG. 15 is an exemplary block diagram of a compensation data generating part of an FSC driving mode LCD device according to a second embodiment of the present invention.

FIG. 15 is an exemplary block diagram of a compensation data generating part of an FSC driving mode LCD device according to a second embodiment of the present invention. Referring to FIG. 15, an external system 1, such as a television system or computer system, provides RGB source data signals to a liquid crystal display device (LCD) 200. The LCD 200 includes a compensation data generating part 210. The compensation data generating part 210 is inputted with the RGB source data signals from the external system 1. The FSC driving mode LCD device 200 also includes a liquid crystal panel, source and scan driving parts, and a timing controlling parts (not shown). The structure and operation of these additional parts are similar to the FSC driving mode LCD device of the first embodiment. Accordingly, a description of the structure and operation of these additional parts will be omitted.

Data signals for displaying mixed colors are generated using the RGB source data signals. Sub-frames are added in the frame period to display an image in the liquid crystal panel. Since the mixed colors are separately displayed, the RGB source data signals are subtracted from the data signal values corresponding to the mixed colors. The data signals generated by this process are the RGB conversion data signals. In the second embodiment, white (W), yellow (Y), cyan (C) and magenta (M) are used as exemplary mixed colors. Selection of the mixed colors may be changed according to need of improving the color mixture property for a specific color.

The compensation data generating part 210 performs arithmetic and/or logical operations, such as addition and subtraction, on the received RGB source data signals to generate RGB conversion data signals, first to third compensation data signals, and a white data signal. The RGB conversion data signals may have a digital format. The first to third compensation data signals can also have a digital format and allows the display of yellow (Y), cyan (C) and magenta (M), respectively. The white data signal has a digital format to display white (W). The FSC driving mode LCD device 200 generates color data signals to display mixed colors including white, and supplies the generated color and white data signals to the liquid crystal panel. Accordingly, brightness is improved and color break-up are reduced.

Figure 16:
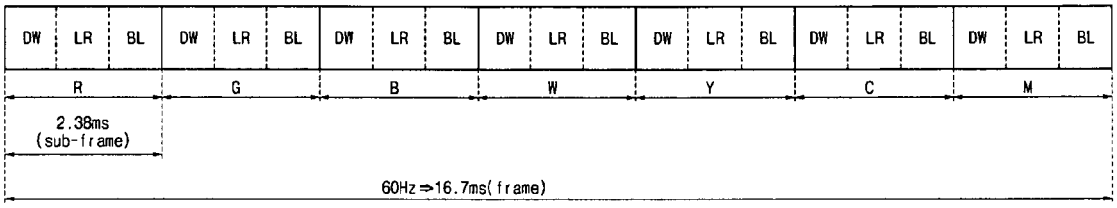
FIG. 16 shows an exemplary partitioning of a frame driven in a FSC driving mode according to the second embodiment of the present invention.

FIG. 16 shows an exemplary partitioning of a frame driven in a FSC driving mode according to the second embodiment of the present invention. Referring to FIG. 16, each frame period is divided into seven sub-frames, corresponding to red (R), green (G), blue (B), white (W), yellow (Y), cyan (C) and magenta (M), respectively. Each sub-frame is in turn divided into a data-writing interval DW, a liquid crystal response interval LR, and a liquid crystal response interval LR. The backlight irradiating interval BL, which is a time for turning on the backlight for each color, is the time remaining in the corresponding sub-frame period after subtracting the data writing interval DW and the liquid crystal response interval LR.

As shown in FIG. 16, when the LCD device has a frame period of about 16.7 ms, which corresponds to a frame rate of about 60 Hz, a sub-frame for displaying each of the RGB conversion data signals, the white data signal and the first to third compensation data signals has a period of about 2.38 ms, which corresponds to 16.7/7. Thus, the backlight irradiating interval BL is shorter than 2.38 ms. According to an embodiment as shown in FIG. 16, the R, G, B, W, Y, C and M sub-frames are sequentially arranged. However, the order of the colors can be changed in other embodiments.

Figure 17:
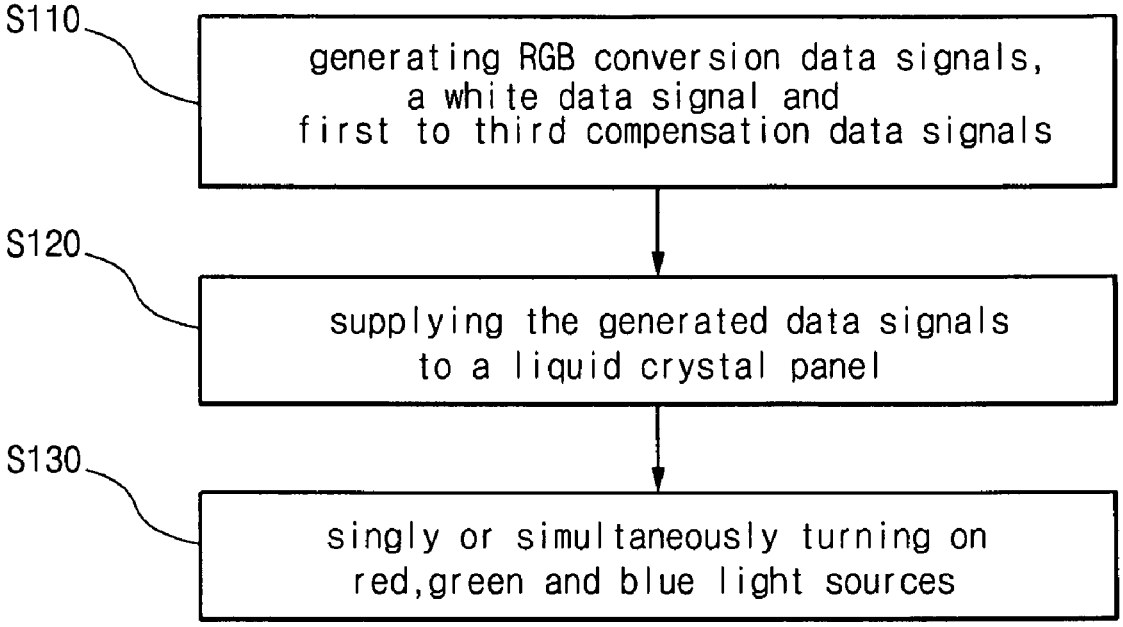
FIG. 17 is an exemplary flow chart illustrating an operation of the FSC driving mode LCD device according to the second embodiment of the present invention.

FIG. 17 is an exemplary flow chart illustrating an operation of the FSC driving mode LCD device according to the second embodiment of the present invention. Referring to FIG. 17, the RGB conversion data signals, the W data signal, and the first to third compensation data signals from RGB source data signals are generated during a first step S110 in the FSC driving mode LCD device. The RGB conversion data signals, the W data signal, and the first to third compensation data signals are supplied to the liquid crystal panel during a second step S120. Then, the red, green and blue light sources from the backlight unit are singly or simultaneously turned on during a third step S130 when each data signal is inputted to the liquid crystal panel 150.

Figure 18:
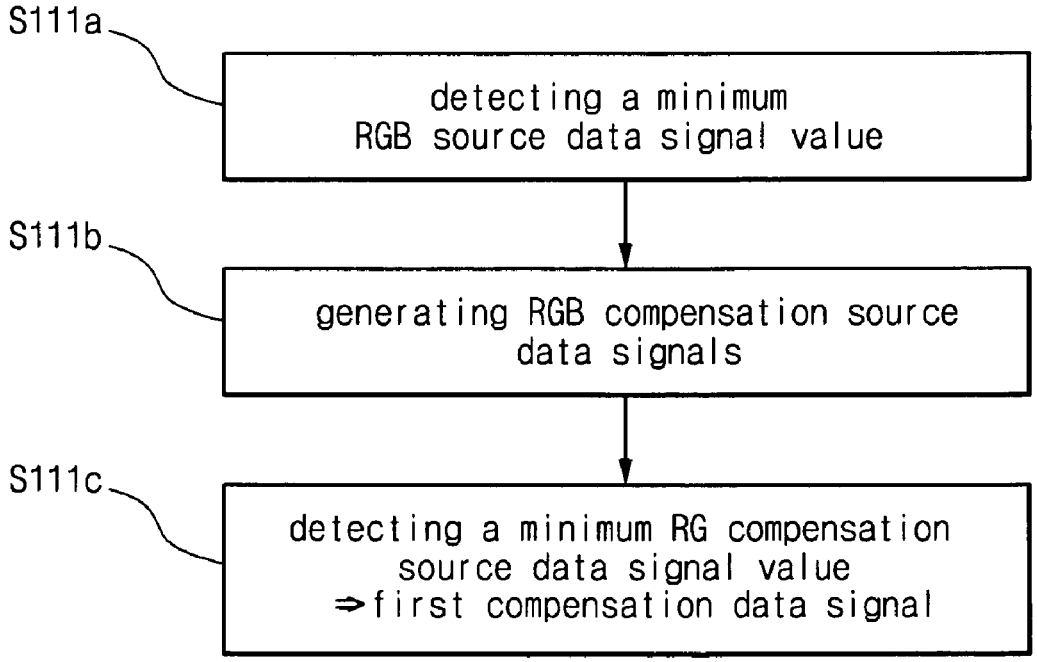
FIG. 18 is an exemplary flow chart illustrating a process for generating a first compensation data signal in the FSC driving mode LCD device according to the second embodiment of the present invention.

FIG. 18 is an exemplary flow chart illustrating a process for generating a first compensation data signal in the FSC driving mode LCD device according to the second embodiment of the present invention. According to the second embodiment, the first compensation data signal corresponds to yellow, which is a mixture of red and green. During a first step S111*a*, a minimum RGB source data signal value is detected between the RGB source data signal values. The W data signal is given the minimum RGB source data value detected in step S111*a*. During a second step S111*b*, the minimum RGB source data signal is subtracted from the RGB source data signals to generate R, G and B compensation source data signals. During a third step S111*c*, a minimum RG compensation source data signal value is detected between the R and G compensation source data signal values. The first compensation data signal is given the detected value of the minimum RG compensation source data signal.

Figure 19:
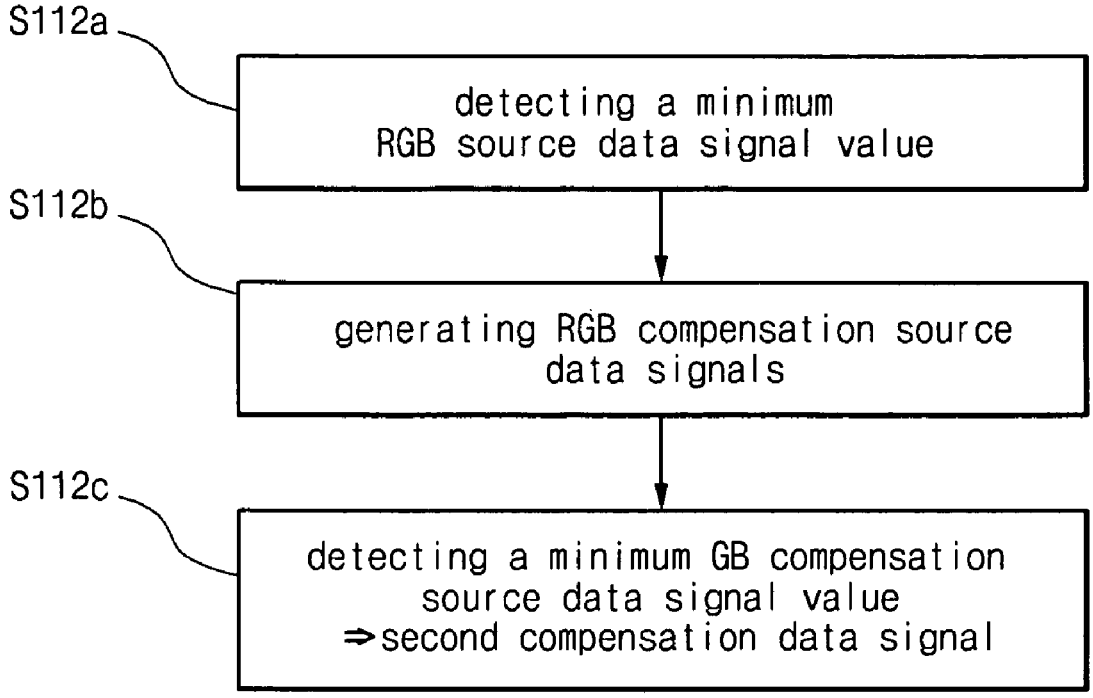
FIG. 19 is an exemplary flow chart illustrating a process for generating a second compensation data signal in the FSC driving mode LCD device according to the second embodiment of the present invention.

FIG. 19 is an exemplary flow chart illustrating a process for generating a second compensation data signal in the FSC driving mode LCD device according to the second embodiment of the present invention. According to the second embodiment, the second compensation data signal corresponds to cyan, which is a mixture of green and blue. During a first step S112*a*, a minimum RGB source data signal value is detected between the RGB source data signal values. During a second step S112*b*, the minimum RGB source data signal is subtracted from the RGB source data signals to generate R, G and B compensation source data signals. During a third step S112*c*, a minimum GB compensation source data signal value is detected between the G and B compensation source data signal values. The second compensation data signal is given the detected value of the minimum GB compensation source data signal.

Figure 20:
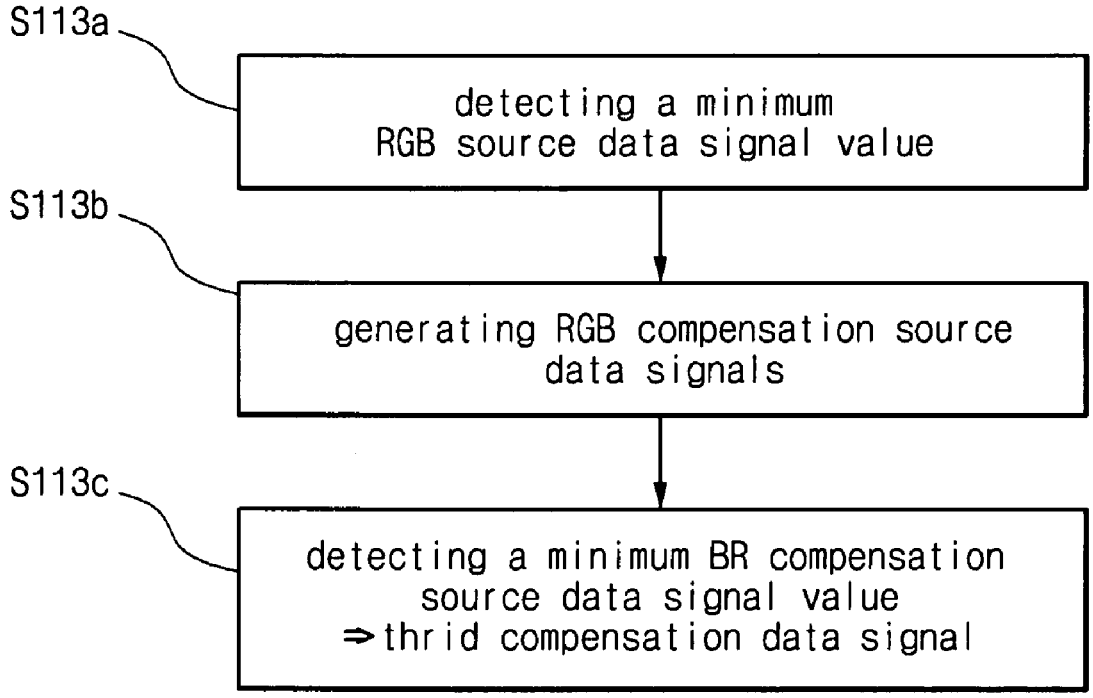
FIG. 20 is an exemplary flow chart illustrating a process for generating a third compensation data signal in the FSC driving mode LCD device according to the second embodiment of the present invention.

FIG. 20 is an exemplary flow chart illustrating a process for generating a third compensation data signal in the FSC driving mode LCD device according to the second embodiment of the present invention. According to the second embodiment, the third compensation data signal corresponds to magenta, which is a mixture of blue and red. During a first step S113*a*, a minimum RGB source data signal value is detected between the RGB source data signal values. During a second step S113*b*, the minimum RGB source data signal is subtracted from the RGB source data signals to generate R, G and B compensation source data signals. During a third step S113*c*, a minimum BR compensation source data signal value is detected between the R and B compensation source data signal values. The third compensation data signal is given the detected value the minimum BR compensation source data signal.

In accordance with the second embodiment, the mixed colors corresponding to the first to third compensation data signals and the W data signal overlap with the red, green and blue of the RGB source data signals. Thus, the RGB conversion data signals are generated by subtracting the overlapped color amounts from the RGB source data signals. For example, the RGB conversion data signals are generated, respectively, by subtracting the W data signal value and the first to third compensation data signal values from the RGB source data signals, respectively. In other words, when the W data signal value is "a", and the first to third compensation data signal values are "b", "c" and "d", respectively, the RGB conversion data signal values R3, G3 and B3 are, R3={R source data signal value−(a+b+c+d)}, G3={G source data signal value−(a+b+c+d)}, and B={B source data signal value−(a+b+c+d)}.

Since the above data signals have a digital format, the RGB conversion data signals, the first to third compensation data signals and the W data signal are generated by arithmetic/logical operations, such as addition and subtraction operations of the RGB source data signals. Also, when a subtracted result is a negative value, for example, a data signal value of 0 is subtracted by a data signal value of 70, the subtracted result is considered as 0.

The RGB conversion data signals, the W data signal and the first to third compensation data signals generated by the above processes are supplied to the liquid crystal display panel. In other words, the RGB conversion data signals, the W data signal and the first to third compensation data signals are transferred to the timing controlling part. The timing controlling part outputs the RGB conversion data signals, the W data signal, the first to third compensation data signals and control signals to the source driving part, and outputs control signals to the scan driving part.

The turn-on controlling part controls one light source corresponding to each data signals for red, green and blue colors in sub-frames when the data signals for red, green and blue colors are inputted. The turn-on controller concurrently turns on two or more light sources to irradiate a mixed color light in sub-frames when the first to third compensation data signals are inputted. For example, the turn-on controlling part concurrently turns on the R and G light sources simultaneously to display Y, the G and B light sources simultaneously to display C, and the blue and red light sources simultaneously to display M. The turn-on controlling part concurrently turns on three R, G and B light sources in the sub-frame corresponding to the W data signal.

Figure 21:
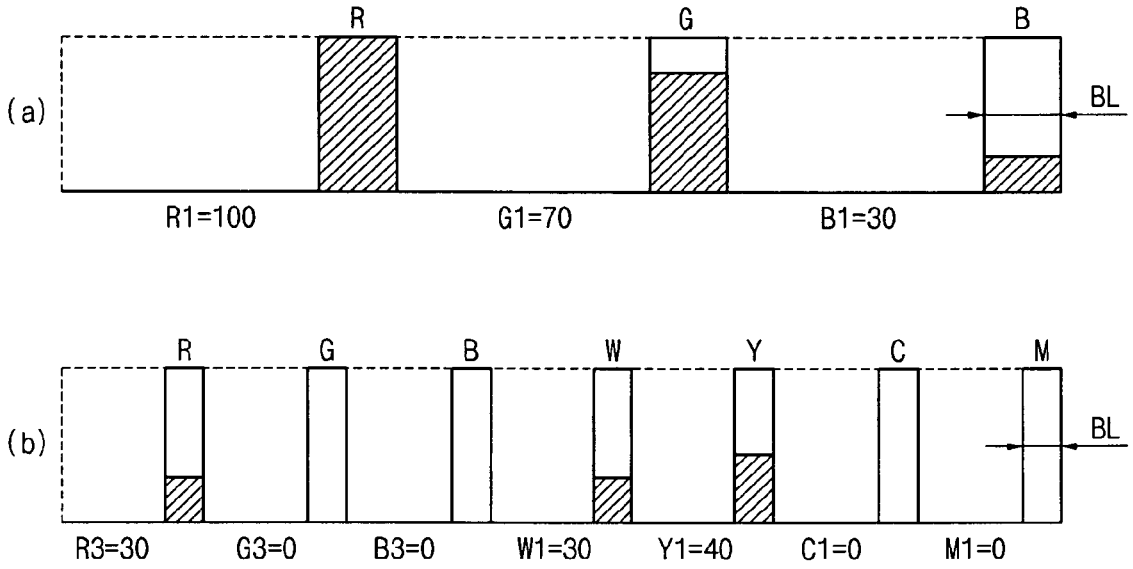
FIG. 21 shows a first graphical comparison between variations of light transmittances across the sub-frames in the related art FSC driving mode LCD device and in the second embodiment of the present invention when displaying an exemplary arbitrary color.

FIG. 21 shows a first graphical comparison between variations of light transmittances across the sub-frames in the related art FSC driving mode LCD device and in the second embodiment of the present invention when displaying an exemplary arbitrary color. FIG. 21, graph (a), illustrates light transmittances through sub-frames of RGB source data signals, when the related art FSC driving mode LCD device is displaying the arbitrary color. FIG. 21, graph (b), illustrates light transmittance through sub-frames of RGB conversion data signals, W data signal, and first to third compensation data signals, when the FSC driving mode LCD device according to the second embodiment of the present invention is displaying the arbitrary color. Data signals values are listed below t each graph and within each corresponding sub-frame. The maximum data signal value, which corresponds to the highest brightness, is assumed to be 100. As illustrated in FIG. 21, graph (a), the RGB source data signal values are R1=100, G1=70 and B1=30 corresponding to an exemplary arbitrary color.

In accordance with the second embodiment of the present invention, RGB conversion data signals, a W data signal and first to third compensation data signals are generated as follows to display the exemplary arbitrary color in the FSC driving mode LCD device. The RGB source data signals have signal values, R1=100, G1=70 and B1=30. Thus, the minimum RGB source data signal value is 30. Accordingly, the W data signal has value W1=30. The corresponding R, G and B compensation source data signals have signal values, R2=(100−30)=70, G2=(70−30)=40, and B2=(30−30)=0, respectively.

The minimum RG compensation source data signal value is 40, which is the minimum between R2=70 and G2=40. Accordingly, the first compensation data signal has a value of Y1=40, which is the minimum RG compensation source data signal value of 40.

The minimum GB compensation source data signal value is 0, which is the minimum between G2=40 and B2=0. Accordingly, the second compensation data has a value of C1=0, which is the minimum GB compensation source data signal value of 0.

The minimum BR compensation source data signal value is 0, which is the minimum between B2=0 and R2=70. Accordingly, the third compensation data signal has a signal value M1=0, which is the minimum BR compensation source data signal value of 0.

The RGB source data signals have signal values, R1=100, G1=70 and B1=30. The W data signal has value W1=30. The first, second and third compensation data signals have the signal values, Y1=40, C1=0 and M1=0, respectively. By subtracting a value 70, (which is the summation of the W data signal, the first compensation data signal value, the second compensation data signal value, and the third compensation data signal value), from the RGB source data signals, respectively, RGB conversion data signals having signal values, R3=30, G3=0 and B3=0, respectively, are generated.

Accordingly, the data signals outputted from the compensation data generating part have signal values, R3=30, G3=0, B3=0, W1=30, Y1=40, C1=0 and M1=0, as illustrated in FIG. 21, graph (b). In the sub-frames, red, green and blue light sources irradiate singly or simultaneously to emit color lights corresponding to the sub-frames. A reference BL represents a backlight-irradiation interval. By adding white, yellow, cyan and magenta, color break-up is improved and brightness increases.

Figure 22:
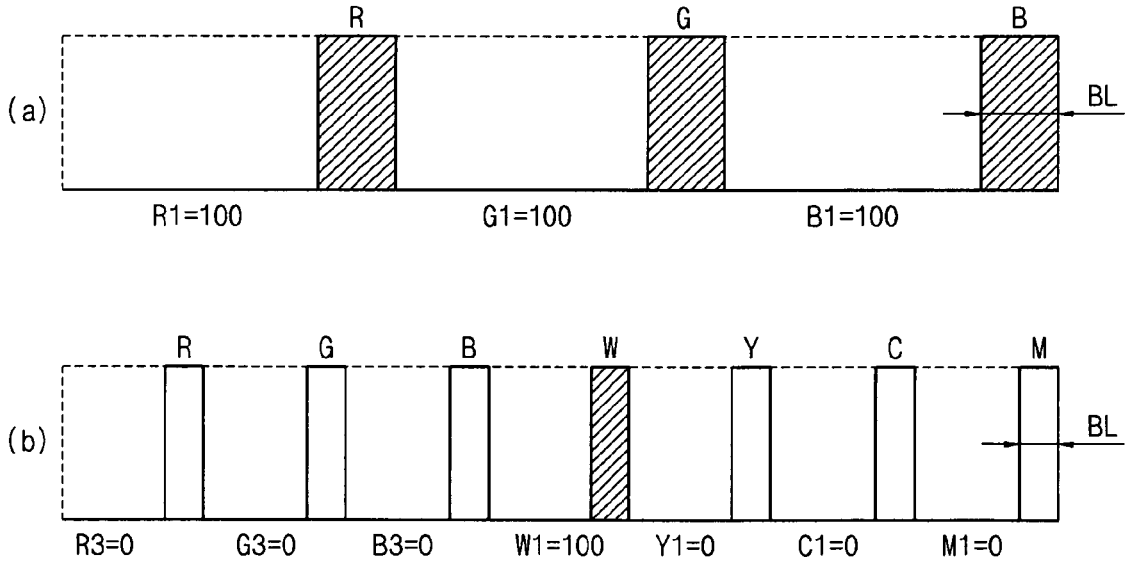
FIG. 22 shows a second graphical comparison between variations of light transmittances across the sub-frames in the related art FSC driving mode LCD device and in the second embodiment of the present invention when displaying white.

FIG. 22 shows a second graphical comparison between variations of light transmittances across the sub-frames in the related art FSC driving mode LCD device and in the second embodiment of the present invention when displaying white. FIG. 22, graph (a), illustrates light transmittances through sub-frames of RGB source data signals, when the related art FSC driving mode LCD device is displaying white. FIG. 22, graph (b) illustrates light transmittance through sub-frames of RGB conversion data signals, a W data signal, and first to third compensation data signals, when the FSC driving mode LCD device according to the second embodiment of the present invention is displaying white. Data signals values are listed below each graph and within each corresponding sub-frame. The maximum data signal value, which corresponds to the highest brightness, is assumed to be 100. As shown in FIG. 22, graph (a), RGB source data signal values are 100 to display white, according to the related art FSC driving mode LCD device.

According to the second embodiment, RGB conversion data signals, a W data signal and first to third compensation data signals are generated as follows to display white. The RGB source data signals have signal values, R1=100, G1=100 and B1=100, respectively. The minimum RGB source data signal value is 100. Accordingly, the W data signal has value W1=100. The R, G and B compensation source data signals have signal values, R2=(100−100)=0, G2=(100−100)=0, and B2=(100−100)=0, respectively.

The minimum RG compensation source data signal value is 0, which is the minimum between R2=0 and G2=0. Accordingly, the first compensation data signal has a value of Y1=0, which is the minimum RG compensation source data signal value of 0.

The minimum GB compensation source data signal value is 0, which is the minimum between G2=0 and B2=0. Accordingly, the second compensation data signal has a value of C1=0, which is the minimum GB compensation source data signal value of 0.

The minimum BR compensation source data signal value is 0, which is the minimum between B2=0 and R2=0. Accordingly, the third compensation data signal has a value of M1=0, which is the minimum BR compensation source data signal value of 0.

The RGB source data signals have signal values R1=100, G1=100 and B1=100. The W data signal has value W1=100. The first, second and third compensation data signals have the signal values, Y1=0, C1=0 and M1=0, respectively. By subtracting a value 100, (which is the summation of the W data signal, the first compensation data signal value, the second compensation data signal value, and the third compensation data signal value), from the RGB source data signals, respectively, RGB conversion data signals having signal values, R3=0, G3=0 and B3=0, respectively, are generated.

Accordingly, the data signals outputted from the compensation data generating part have signal values, R3=0, G3=0, B3=0, W1=100, Y1=0, C1=0 and M1=0, as illustrated in FIG. 22, graph (b). In the sub-frames, red, green and blue light sources irradiate singly or simultaneously to emit color lights corresponding to the sub-frames. A reference BL represents a backlight-irradiation interval. By adding white, yellow, cyan and magenta, color break-up is improved and brightness increases.

Figure 23:
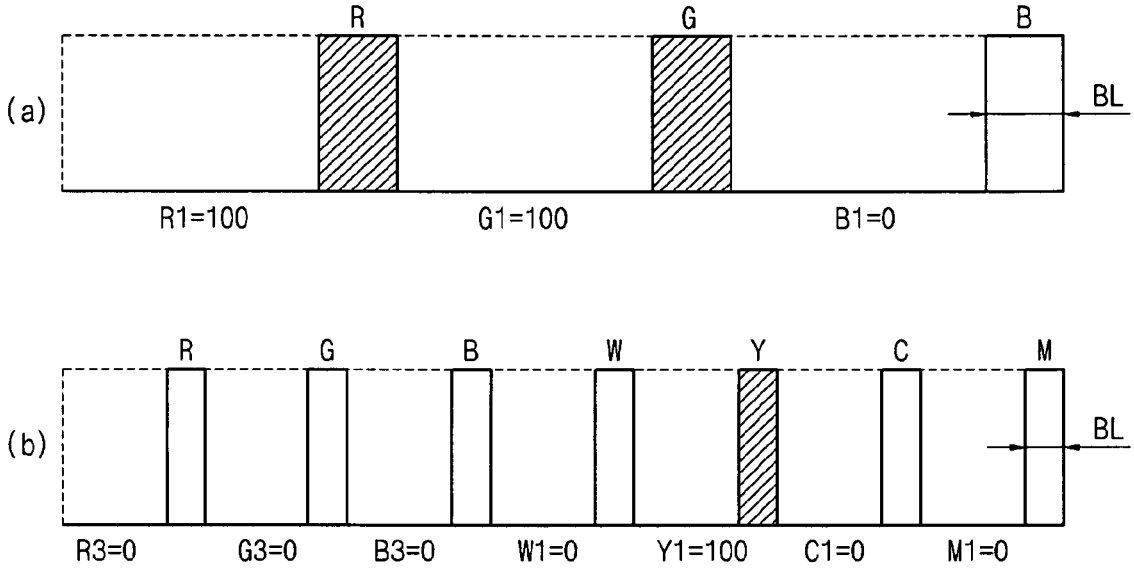
FIG. 23 shows a second graphical comparison between variations of light transmittances across the sub-frames in the related art FSC driving mode LCD device and in the second embodiment of the present invention when displaying yellow.

FIG. 23 shows a third graphical comparison between variations of light transmittances across the sub-frames in the related art FSC driving mode LCD device and in the second embodiment of the present invention when displaying yellow. Referring to FIG. 23, graph (a) illustrates light transmittances through sub-frames of RGB source data signals in the related art FSC driving mode LCD device, and graph (b) illustrates light transmittance through sub-frames of RGB conversion data signals, a W data signal and first to third compensation data signals in the FSC driving mode LCD device according to the second embodiment of the present invention, when displaying yellow. Data signals values are listed below each graph and within each corresponding sub-frame. The maximum data signal value, which corresponds to the highest brightness, is assumed to be 100. As shown in FIG. 23, graph (a), the RGB source data signals have signal values R1=100, G1=100 and B1=0 to display yellow.

RGB conversion data signals, a W data signal and first to third compensation data signals are generated as follows, in accordance with the second embodiment of the present invention. The RGB source data signals have signal values, R1=100, G1=100 and B1=0, respectively. The corresponding minimum RGB source data signal value is 0. Thus, the W data signal has a value of 0. The R, G and B compensation source data signals have signal values R2=(100−0)=100, G2=(100−0)=100, and B2=(0−0)=0, respectively.

The minimum RG compensation source data signal, which is the minimum between R2=100 and G2=100, has a value of 100. Accordingly, the first compensation data signal, which is the minimum RG compensation source data signal value of 100, has a signal value of Y1=100.

Similarly, the minimum GB compensation source data signal value, which is the minimum between G2=100 and B2=0, is 0. Accordingly, the second compensation data signal, which is the minimum GB compensation source data signal value of 0, has a signal value of C1=0.

Furthermore, the minimum BR compensation source data signal value, which is the minimum between B2=0 and R2=100, is also 0. Accordingly, the third compensation data signal, which is the minimum BR compensation source data signal value of 0, also has a data signal value of M1=0.

The RGB source data signals have signal values R1=100, G1=100 and B1=0. The W data signal has value W1=0. The first, second and third compensation data signals have the signal values, Y1=0, C1=0 and M1=0, respectively. By subtracting a value 100, (which is the summation of the W data signal, the first compensation data signal value, the second compensation data signal value, and the third compensation data signal value), from the RGB source data signals, respectively, RGB conversion data signals having signal values R3=0, G3=0 and B3=0, respectively, are generated.

Accordingly, the data signals outputted from the compensation data generating part have signal values, R3=0, G3=0, B3=0, W1=0, Y1=100, C1=0 and M1=0, as illustrated in FIG. 23, graph (b). In the sub-frames, red, green and blue light sources irradiate singly or at least two simultaneously to emit color lights corresponding to the sub-frames. A reference BL represents a backlight-irradiation interval. By adding white, yellow, cyan and magenta, color break-up is improved and brightness increases.

Figure 24:
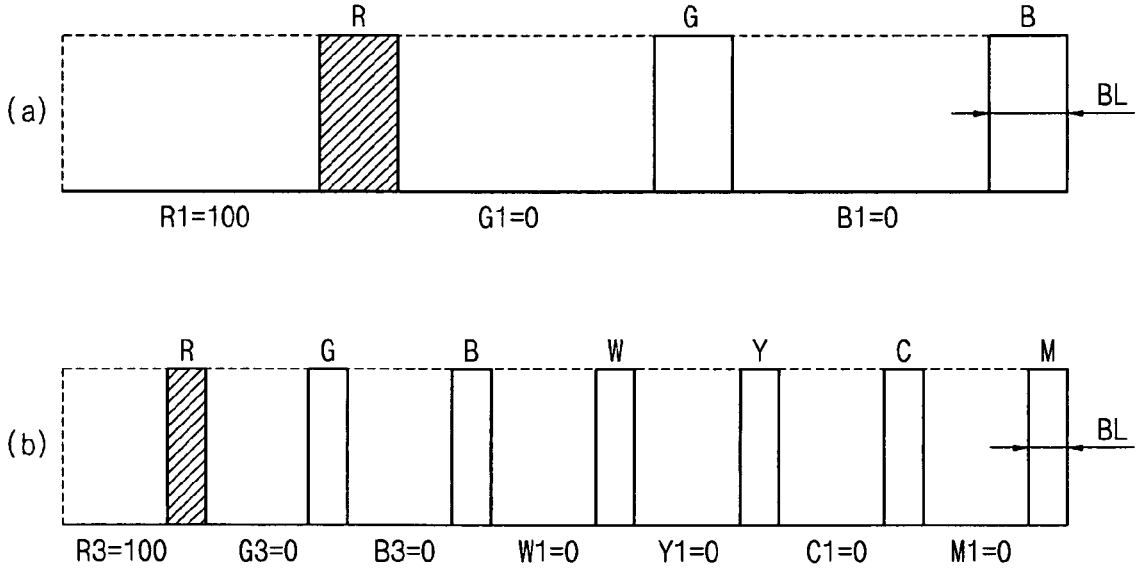
FIG. 24 shows a fourth graphical comparison between variations of light transmittances across the sub-frames in the related art FSC driving mode LCD device and in the second embodiment of the present invention when displaying red.

FIG. 24 shows a fourth graphical comparison between variations of light transmittances across the sub-frames in the related art FSC driving mode LCD device and in the second embodiment of the present invention when displaying red. Referring to FIG. 24, graph (a) illustrates light transmittances through sub-frames of RGB source data signals in the related art FSC driving mode LCD device, and graph (b) illustrates light transmittance through sub-frames of RGB conversion data signals, a W data signal and first to third compensation data signals in the FSC driving mode LCD device according to the second embodiment of the present invention, when displaying red. Data signals values are listed below each graph and within each corresponding sub-frame. The maximum data signal value, which corresponds to the highest brightness, is assumed to be 100. As shown in FIG. 24, graph (a), the RGB source data signals have signal values R1=100, G1=0 and B1=0 to display red.

RGB conversion data signals, a W data signal and first to third compensation data signals are generated as follows, in accordance with the second embodiment of the present invention. The RGB source data signals have signal values, R1=100, G1=0 and B1=0, respectively. The corresponding minimum RGB source data signal value is 0. Thus, the W data signal has a value of 0. The R, G and B compensation source data signals have signal values R2=(100−0)=100, G2=(0−0)=0, and B2=(0−0)=0, respectively.

The minimum RG compensation source data signal, which is the minimum between R2=100 and G2=0, has a value of 0. Accordingly, the first compensation data signal, which is the minimum RG compensation source data signal value of 0, has a signal value of Y1=0.

Similarly, the minimum GB compensation source data signal value, which is the minimum between G2=0 and B2=0, is 0. Accordingly, the second compensation data signal, which is the minimum GB compensation source data signal value of 0, has a signal value of C1=0.

Furthermore, the minimum BR compensation source data signal value, which is the minimum between B2=0 and R2=100, is also 0. Accordingly, the third compensation data signal, which is the minimum BR compensation source data signal value of 0, also has a data signal value of M1=0.

The RGB source data signals have signal values R1=100, G1=0 and B1=0. The W data signal has value W1=0. The first, second and third compensation data signals have the signal values, Y1=0, C1=0 and M1=0, respectively. By subtracting a value 0, (which is the summation of the W data signal, the first compensation data signal value, the second compensation data signal value, and the third compensation data signal value), from the RGB source data signals, respectively, RGB conversion data signals having signal values R3=100, G3=0 and B3=0, respectively, are generated.

Accordingly, the data signals outputted from the compensation data generating part have signal values, R3=100, G3=0, B3=0, W1=0, Y1=0, C1=0 and M1=0, as illustrated in FIG. 24, graph (b). In the sub-frames, red, green and blue light sources irradiate singly or at least two simultaneously to emit color lights corresponding to the sub-frames. A reference BL represents a backlight-irradiation interval. By adding white, yellow, cyan and magenta, color break-up is improved and brightness increases.

As explained above, the FSC driving mode LCD device of the second embodiment display an image using more colors than the related art. Accordingly, color break-up and color mixture distortion are reduced. Also, color reproduction rate for solid color is improved. Further, the sub-frame displaying white is further added to increase brightness.

In accordance with another embodiment, a separate white light source may be used for the white sub-frame in place of simultaneous irradiation of red, green and blue light sources.

In accordance with another embodiment, the backlight unit can be used with another type of display device.

It will be apparent to those skilled in the art that various modifications and variations may be made in the driving method of the liquid crystal display device without departing from the spirit or scope of the invention. Thus, it is intended that the present invention cover the modifications and variations provided they come within the scope of the appended claims and their equivalents.

What is claimed is:

1. A liquid crystal display device, comprising:

a compensation data generating part for converting a source data signal into a conversion data signal and a compensation data signal, wherein the source data signal includes a red source data signal, a green source data signal and a blue source data signal, wherein the conversion data signal includes a red conversion data signal, a green conversion data signal and a blue conversion data signal, and wherein the compensation data signal includes a yellow data signal, a cyan data signal and a magenta data signal, or a white data signal, a yellow data signal, a cyan data signal and a magenta data signal; and a backlight unit, including a plurality of light sources that include a red light source, a green light source and a blue light source, for performing a single irradiation of one of the plurality of light sources to display the conversion data signal and performing a simultaneous irradiation of at least two of the plurality of light sources to display the compensation data signal, wherein, for converting the source data signal, the compensation data generating part is operative to:

detect a first minimum value of the red source data signal, the green source data signal and the blue source data signal;

generate a red compensation data signal, a green compensation data signal, and a blue compensation data signal by subtracting the minimum value of the red source data signal, the green source data signal and the blue source data signal from each of the red source data signal, the green source data signal and the blue source data signal, respectively;

detect a second minimum value between the red compensation data signal and the green compensation data signal, a third minimum value between the green compensation data signal and the blue compensation data signal, and a fourth minimum value between the red compensation data signal and the blue compensation data signal; and generate a first compensation data signal by adding the first minimum value to the second minimum value, a second compensation data signal by adding the first minimum value to the third minimum value, and a third compensation data signal by adding the first minimum value to the fourth minimum value.

2. The device of claim 1, wherein the plurality of light sources includes at least one of a first plurality of light emitting diodes and a second plurality of fluorescent lamps.

3. The device of claim 1, wherein the backlight unit includes a turn-on controller for alternately performing the single irradiation during a first sub-frame and for performing the simultaneous irradiation during a subsequent sub-frame.

4. The device of claim 1, wherein the backlight unit displays one of the at least one of the red conversion data signal, the green conversion data signal and the blue conversion data signal alternately with one of the at least one of the yellow data signal, the cyan data signal, and the magenta data signal.

5. The device of claim 1, wherein the backlight unit sequentially displays each of the red conversion data signal, the green conversion data signal and the blue conversion data signal prior to display each of the at least one of the yellow, the cyan, and the magenta data signals.

6. The device of claim 1, further comprising:

a liquid crystal panel;

a source driving part for outputting the conversion data signal and the compensation data signal to the liquid crystal panel;

a scan driving part for outputting scan signals to the liquid crystal panel; and a timing controlling part for controlling outputting of the source and scan driving parts and transferring the conversion data signal and the compensation data signal from the compensation data generating part to the source driving part.

7. A method of driving a liquid crystal display device, comprising:

converting a source data signal into a conversion data signal and a compensation data signal, wherein the source data signal includes a red source data signal, a green source data signal and a blue source data signal, wherein the conversion data signal includes a red conversion data signal, a green conversion data signal and a blue conversion data signal, and wherein the compensation data signal includes a yellow data signal, a cyan data signal and a magenta data signal, or a white data signal, a yellow data signal, a cyan data signal and a magenta data signal; and performing a single irradiation of one of a plurality of light sources, which include a red light source, a green light source and a blue light source, to display the conversion data signal and performing a simultaneous irradiation of at least two of the plurality of light sources to display the compensation data signal, wherein the converting of the source data signal includes:

detecting a first minimum value of the red source data signal, the green source data signal and the blue source data signal;

generating a red compensation data signal, a green compensation data signal, and a blue compensation data signal by subtracting the minimum value of the red source data signal, the green source data signal and the blue source data signal from each of the red source data signal, the green source data signal and the blue source data signal, respectively;

detecting a second minimum value between the red compensation data signal and the green compensation data signal, a third minimum value between the green compensation data signal and the blue compensation data signal, and a fourth minimum value between the red compensation data signal and the blue compensation data signal; and generating a first compensation data signal by adding the first minimum value to the second minimum value, a second compensation data signal by adding the first minimum value to the third minimum value, and a third compensation data signal by adding the first minimum value to the fourth minimum value.

8. The method of claim 7, wherein the plurality of light sources includes at least one of a first plurality of light emitting diodes and second plurality of fluorescent lamps.

9. The method of claim 7, including alternately performing the single irradiation during a first sub-frame and the simultaneous irradiation during a subsequent sub-frame.

10. The method of claim 7, including displaying one of the at least one of the red conversion data signal, the green conversion data signal and the blue conversion data signal alternately with one of the at least one of the yellow data signal, the cyan data signal, and the magenta data signal.

11. The method of claim 7, including sequentially displaying each of the at least one of the red conversion data signal, the green conversion data signal and the blue conversion data signal and subsequently displaying each of the at least one of the yellow data signal, the cyan data signal, and the magenta data signal.

12. The method of claim 7, including sequentially displaying each of the at least one of the red conversion data signal, the green conversion data signal and the blue conversion data signal and subsequently displaying each of the at least one of the white data signal, the yellow data signal, the cyan data signal, and the magenta data signal.

13. A method of driving a liquid crystal display device, comprising:

converting a source data signal into a conversion data signal and a compensation data signal, wherein the source data signal includes a red source data signal, a green source data signal and a blue source data signal, wherein the conversion data signal includes a red conversion data signal, a green conversion data signal and a blue conversion data signal, and wherein the compensation data signal includes a yellow data signal, a cyan data signal and a magenta data signal, or a white data signal, a yellow data signal, a cyan data signal and a magenta data signal; and performing a single irradiation of one of a plurality of light sources, which include a red light source, a green light source and a blue light source, to display the conversion data signal and performing a simultaneous irradiation of at least two of the plurality of light sources to display the compensation data signal, wherein the converting of the source data signal includes:

detecting a first minimum value of the red source data signal, the green source data signal and the blue source data signal;

generating a red compensation data signal, a green compensation data signal, and a blue compensation data signal by subtracting the minimum value of the red source data signal, the green source data signal and the blue source data signal from each of the red source data signal, the green source data signal and the blue source data signal, respectively;

detecting a second minimum value between the red compensation data signal and the green compensation data signal, a third minimum value between the green compensation data signal and the blue compensation data signal, and a fourth minimum value between the red compensation data signal and the blue compensation data signal; and generating the red conversion data signal by subtracting the second, third and fourth minima from the red compensation data signal, the green conversion data signal by subtracting the second, third and fourth minima from the green compensation data signal, and the blue conversion data signal by subtracting the second, third and fourth minima from the blue compensation data signal.

14. A method of driving a liquid crystal display device, comprising:

converting a source data signal into a conversion data signal and a compensation data signal, wherein the source data signal includes a red source data signal, a green source data signal and a blue source data signal, wherein the conversion data signal includes a red conversion data signal, a green conversion data signal and a blue conversion data signal, and wherein the compensation data signal includes a yellow data signal, a cyan data signal and a magenta data signal, or a white data signal, a yellow data signal, a cyan data signal and a magenta data signal; and performing a single irradiation of one of a plurality of light sources which include a red light source, a green light source and a blue light source, to display the conversion data signal and performing a simultaneous irradiation of at least two of the plurality of light sources to display the compensation data signal, wherein the converting of the source data signal includes:

generating the white data signal including detecting a first minimum value of the red source data signal, the green source data signal and the blue source data signal;

generating a red compensation data signal, a green compensation data signal, and a blue compensation data signal by subtracting the first minimum value from each of the red source data signal, the green source data signal and the blue source data signal, respectively; and generating a first compensation signal including detecting a second minimum value between the red compensation data signal and the green compensation data signal.

15. A method of driving a liquid crystal display device, comprising:

converting a source data signal into a conversion data signal and a compensation data signal, wherein the source data signal includes a red source data signal, a green source data signal and a blue source data signal, wherein the conversion data signal includes a red conversion data signal, a green conversion data signal and a blue conversion data signal, and wherein the compensation data signal includes a yellow data signal, a cyan data signal and a magenta data signal, or a white data signal, a yellow data signal, a cyan data signal and a magenta data signal; and performing a single irradiation of one of a plurality of light sources which include a red light source, a green light source and a blue light source, to display the conversion data signal and performing a simultaneous irradiation of at least two of the plurality of light sources to display the compensation data signal, wherein the converting of the source data signal includes:

generating the white data signal including detecting a first minimum value of the red source data signal, the green source data signal and the blue source data signal;

generating a red compensation data signal, a green compensation data signal, and a blue compensation data signal by subtracting the first minimum value from each of the red source data signal, the green source data signal and the blue source data signal, respectively;

generating a first compensation signal including detecting a second minimum value between the red compensation data signal and the green compensation data signal;

generating a second compensation signal including detecting a third minimum value between the green compensation data signal and the blue compensation data signal; and generating a third compensation signal including detecting a fourth minimum value between the red compensation data signal and the blue compensation data signal.

16. The method of claim 15, wherein generating the red conversion data signal includes subtracting the white data signal and the first to third compensation data signals from the red source data signal.

17. The method of claim 15, wherein generating the red conversion data signal includes subtracting the white data signal and the first to third compensation data signals from the red source data signal, generating the green conversion data signal includes subtracting the white data signal and the first to third compensation data signals from the green source data signal, and generating the blue conversion data signal includes subtracting the white data signal and the first to third compensation data signals from the blue source data signal.

18. A liquid crystal display device, comprising:

a compensation data generating part for converting a source data signal into a conversion data signal and a compensation data signal, wherein the source data signal includes a red source data signal, a green source data signal and a blue source data signal, wherein the conversion data signal includes a red conversion data signal, a green conversion data signal and a blue conversion data signal, and wherein the compensation data signal includes a yellow data signal, a cyan data signal and a magenta data signal, or a white data signal, a yellow data signal, a cyan data signal and a magenta data signal; and a backlight unit, including a plurality of light sources that include a red light source, a green light source and a blue light source, for performing a single irradiation of one of the plurality of light sources to display the conversion data signal and performing a simultaneous irradiation of at least two of the plurality of light sources to display the compensation data signal, wherein, for converting the source data signal, the compensation data generating part is operative to:

detect a first minimum value of the red source data signal, the green source data signal and the blue source data signal;

generate a red compensation data signal, a green compensation data signal, and a blue compensation data signal by subtracting the minimum value of the red source data signal, the green source data signal and the blue source data signal from each of the red source data signal, the green source data signal and the blue source data signal, respectively;

detect a second minimum value between the red compensation data signal and the green compensation data signal, a third minimum value between the green compensation data signal and the blue compensation data signal, and a fourth minimum value between the red compensation data signal and the blue compensation data signal; and generate the red conversion data signal by subtracting the second, third and fourth minima from the red compensation data signal, the green conversion data signal by subtracting the second, third and fourth minima from the green compensation data signal, and the blue conversion data signal by subtracting the second, third and fourth minima from the blue compensation data signal.

19. A liquid crystal display device, comprising:

a compensation data generating part for converting a source data signal into a conversion data signal and a compensation data signal, wherein the source data signal includes a red source data signal, a green source data signal and a blue source data signal, wherein the conversion data signal includes a red conversion data signal, a green conversion data signal and a blue conversion data signal, and wherein the compensation data signal includes a yellow data signal, a cyan data signal and a magenta data signal, or a white data signal, a yellow data signal, a cyan data signal and a magenta data signal; and a backlight unit, including a plurality of light sources that include a red light source, a green light source and a blue light source, for performing a single irradiation of one of the plurality of light sources to display the conversion data signal and performing a simultaneous irradiation of at least two of the plurality of light sources to display the compensation data signal, wherein, for converting the source data signal, the compensation data generating part is operative to:

generate the white data signal including detecting a first minimum value of the red source data signal, the green source data signal and the blue source data signal;

generate a red compensation data signal, a green compensation data signal, and a blue compensation data signal by subtracting the first minimum value from each of the red source data signal, the green source data signal and the blue source data signal, respectively; and generate a first compensation signal including detecting a second minimum value between the red compensation data signal and the green compensation data signal.

20. A liquid crystal display device, comprising:

a compensation data generating part for converting a source data signal into a conversion data signal and a compensation data signal, wherein the source data signal includes a red source data signal, a green source data signal and a blue source data signal, wherein the conversion data signal includes a red conversion data signal, a green conversion data signal and a blue conversion data signal, and wherein the compensation data signal includes a yellow data signal, a cyan data signal and a magenta data signal, or a white data signal, a yellow data signal, a cyan data signal and a magenta data signal; and a backlight unit, including a plurality of light sources that include a red light source, a green light source and a blue light source, for performing a single irradiation of one of the plurality of light sources to display the conversion data signal and performing a simultaneous irradiation of at least two of the plurality of light sources to display the compensation data signal, wherein, for converting the source data signal, the compensation data generating part is operative to:

generate the white data signal including detecting a first minimum value of the red source data signal, the green source data signal and the blue source data signal;

generate a red compensation data signal, a green compensation data signal, and a blue compensation data signal by subtracting the first minimum value from each of the red source data signal, the green source data signal and the blue source data signal, respectively;

generate a first compensation signal including detecting a second minimum value between the red compensation data signal and the green compensation data signal;

generate a second compensation signal including detecting a third minimum value between the green compensation data signal and the blue compensation data signal; and generate a third compensation signal including detecting a fourth minimum value between the red compensation data signal and the blue compensation data signal.

* * * * *